US007608819B2

(12) United States Patent
Baba et al.

(10) Patent No.: US 7,608,819 B2
(45) **Date of Patent: *Oct. 27, 2009**

(54) MASS SPECTROMETER

(75) Inventors: Takashi Baba, Kawagoe (JP); Yuichiro Hashimoto, Tachikawa (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/078,523

(22) Filed: Apr. 1, 2008

(65) Prior Publication Data

US 2008/0185516 A1 Aug. 7, 2008

Related U.S. Application Data

(63) Continuation of application No. 11/605,437, filed on Nov. 29, 2006, now Pat. No. 7,381,946, which is a continuation of application No. 11/006,591, filed on Dec. 8, 2004, now Pat. No. 7,166,835.

(30) Foreign Application Priority Data

Feb. 17, 2004 (JP) ..... 2004-039502

(51) Int. Cl.
*H01J 49/00* (2006.01)

(52) U.S. Cl. ..... 250/288; 250/281; 250/282; 250/427

(58) Field of Classification Search ..... 250/281, 250/282, 288, 427
See application file for complete search history.

(56) References Cited

U.S. PATENT DOCUMENTS 4,563,579 A 1/1986 Kellerhals et al.

(Continued)

FOREIGN PATENT DOCUMENTS

WO WO 03/102545 A2 5/2003

(Continued)

OTHER PUBLICATIONS

R.W. Vachet et al., "Electron Capture by Ions in a Quadrupole Ion Trap", 43rd ASMS Conference on Mass Spectrometry and Allied Topics, (1995), p. 1111.

(Continued)

*Primary Examiner*—David A. Vanore
(74) *Attorney, Agent, or Firm*—Stites & Harbison PLLC; Juan Carlos A. Marquez, Esq.

(57) ABSTRACT

The present invention provides a mass spectrometry capable of high-efficiency and high-throughput ECD. An electron source and a two-dimensional combined ion trap in which a magnetic field along and generally parallel to a central axis is applied are used, thereby to achieve the foregoing object. First, precursor ions are trapped. By adopting the two-dimensional combined ion trap, it is possible to obtain a high ion trapping efficiency upon being injected and trapping. Subsequently, electrons are made incident thereon in such a manner as to be wound along the central axis to which no radio frequency is applied by using a magnetic field. For this reason, it is possible to allow energy-controlled electrons to reach the precursor ions. It is possible to implement a mass spectrometer capable of avoiding heating due to a radio frequency electric field, and effecting high-throughput/high-efficiency ECD.

16 Claims, 21 Drawing Sheets

U.S. PATENT DOCUMENTS

| | | | | |
|---|---|---|---|---|
| 6,800,851 | B1 | 10/2004 | Zubarev et al. | |
| 7,166,835 | B2 * | 1/2007 | Baba et al. | 250/281 |
| 7,381,946 | B2 * | 6/2008 | Baba et al. | 250/288 |
| 2003/0155507 | A1 | 8/2003 | Hashimoto et al. | |
| 2003/0183760 | A1 | 10/2003 | Tsybin et al. | |
| 2004/0245448 | A1 | 12/2004 | Glish et al. | |
| 2005/0017167 | A1 | 1/2005 | Franzen | |

FOREIGN PATENT DOCUMENTS

WO WO 03/102545 A3 5/2003

OTHER PUBLICATIONS

Baba et al., "Electron Capture Dissociation in a Tiny Penning Trap Coupled with a Linear Radio-Frequency-Quadrupole Ion Trap—Time-of-Flight Mass Spectrometer", 51st ASMS Conference on Mass Spectrometry and Allied Topics, (2003), 2 pages.

Ivonin et al., "Numerical Simulations of Electron Capture by Cations in Paul Traps", 51st ASMS Conference on Mass Spectrometry and Allied Topics, (2003), 2 pages.

Frank Kjeldsen et al., "Dissociative Capture of Hot (3-13 eV) Electrons by Polypeptide Polycations: an Efficient Process Accompanied by Secondary Fragmentation", Chemical Physics Letters, (2002), pp. 201-206.

Jae C. Schwartz et al., "A Two-Dimensional Quadrupole Ion Trap Mass Spectrometer", 2002 American Society for Mass Spectrometry, vol. 13, pp. 659-669.

European Search Report dated Mar. 8, 2006.

Kelleher, Neil L. et al, "Localization of Labile Posttranslational Modifications by Electron capture Dissociation: The Case of γ-Carboxyglutamic Acid", Anal. Chem., vol. 71, 1999, pp. 4250-4253.

Olsen, Jesper V. et al., "Comparison of electron capture dissociation and collisionally activated dissociation of polycations of peptide nucleic acids", Rapid Commun. Mass Spectrom., vol. 15, 2001, pp. 969-974.

* cited by examiner

MASS SPECTROMETER

CROSS-REFERENCE TO RELATED APPLICATION

This application is a Continuation application of U.S. application Ser. No. 11/605,437 filed Nov. 29, 2006, now U.S. Pat. No. 7,381,946 which is a Continuation of U.S. application Ser. No. 11/006,591 filed Dec. 8, 2004 now U.S. Pat. No. 7,166,835. Priority is claimed based on U.S. application Ser. No. 11/605,437 filed Nov. 29, 2006, which claims the priority on U.S. application Ser. No. 11/006,591 filed Dec. 8, 2004, which claims the priority of Japanese Patent Application No. 2004-039502 filed on Feb. 17, 2004, all of which is incorporated by reference.

BACKGROUND OF THE INVENTION

The present invention relates to a sequence structure analysis of a biopolymer using mass spectrometry.

Nowadays, the analysis of the human DNA sequence has been completed, which puts importance on the structure analysis of proteins generated using the genome information, or biomolecules undergoing posttranslational modification for functioning in the cell based on the proteins.

One of the structure analysis means technique widely used is mass spectrometry. Using the mass spectrometers, such as, an ion trap, a Q mass filter, and the time-of-flight (TOF) mass spectrometer, it is possible to obtain information of the sequence of peptides or proteins. The mass spectrometers have high throughput feature, therefore, they have a good connectivity with sample preparation means for separating a sample, such as a liquid chromatography apparatus. Thus, it is valuable for proteomics analysis, especially for high throughput analysis, and hence it finds a wide range of use.

In mass spectrometry, sample molecules are ionized, and injected into a vacuum (or ionized in a vacuum). The motion of the ions in the electromagnetic field is measured, thereby to determine mass-to-charge ratio of the target molecule ions. It is not possible to obtain as far as the internal structure information with only single mass analysis operation, therefore, a method referred to as a tandem mass spectrometry is used. Namely, the sample molecule ions are identified or selected by the first mass analysis operation. These ions are referred to as precursor ions. Subsequently, the precursor ions are dissociated. The dissociated ions are referred to as fragment ions. The fragment ions are further subjected to mass analysis, thereby to obtain information of patterns of the fragment ions. Each dissociation reaction has own dissociation pattern, which enables the judgment of the sequence structure of the precursor ions. In particular, in biomolecule analysis, Collision Induced Dissociation (CID), Infra Red Multi Photon Dissociation (IRMPD), and Electron Capture Dissociation (ECD) are adopted.

In the current protein analysis, the most widely used technique is CID. The precursor ions are kinetically energized, and collided with a gas. The molecular vibrations of the precursor ions are excited by the collision, so that dissociation occurs at weak parts of the molecular chain. Whereas, the method which has recently come into use is IRMPD. The precursor ions are irradiated with an infrared laser beam, and allowed to absorb a large number of photons. This excites molecular vibrations, so that dissociation occurs at the weak parts of the molecular chain. The dissociation by CID or IRMPD occurs the sites named a-x and b-y as shown in FIG. 10, out of the backbone composed of an amino acid sequence. Even the a-x and b-y sites may be difficult to cut according to the kind of the amino acid sequence pattern. Therefore, it is known that complete structure analysis cannot be carried out only with CID or IRMPD. For this reason, a sample preparation pretreatment such as digestion using an enzyme becomes necessary, which inhibits high-speed analysis. Whereas, for the biomolecules which have undergone posttranslational modification, when CID or IRMPD is used, the side chain resulting from the posttranslational modification tends to be lost. The side chain tends to be lost, and hence it is possible to determine the modified molecular species from the lost mass. However, the important information regarding the modification site has been done is lost.

On the other hand, ECD which is another dissociation means does not depend upon the amino acid sequence, whereby one position of the c-z site as shown in FIG. 10 on the backbone of the amino acid sequence is dissociated. For this reason, the protein molecules can be completely analyzed by only the mass analytic technique. Further, ECD has a feature of being less likely to dissociate the side chain, and hence is suitable for the means for study/analysis of the posttranslational modification. For this reason, the technique which has particularly received attention in recent years is this dissociation technique referred to as ECD.

It is known that the electron energy required for effecting the ECD reaction is about 1 electron volt (Frank Kjeldsen and Roman Zubarev: Chem. Phys. Lett., 356 (2002) 201-206). Also as is known, the electron capture reaction is caused even at in the vicinity of 10 eV. With the HECD, a large number of fragment ions are generated in each of which in addition to the c-z site, other sites including the a-x site and the b-y site. For using ECD and HECD differently, the control of the electron energy at a precision of 1 eV or less becomes necessary. It has been shown by the study using FT-ICR that ECD is effective for the protein structure analysis/posttranslational modification analysis.

As described above, CID and IRMPD, and ECD respectively provide different sequence information, and hence they can be used complementarily to each other. As one method, CID and IRMPD are used as the main dissociation means. Then, when a complete analysis is impossible with CID and IRMPD, ECD is used complementarily.

However, at the present time, ECD is implemented only by FT-ICR mass spectrometer, but it is not implemented by an industrially widely used radio frequency mass spectrometer such as a radio frequency ion trap and a Q-mass filter. The reason why ECD has been quickly implemented with FT-ICR is based on the principle of trapping of ions. With FT-ICR, a static electromagnetic field is used for trapping ions. Use of a static electromagnetic field enables the introduction of electrons to the trapped ions with a kinetic energy as low as 1 eV with the ions trapped. Namely, the electrons will not be accelerated by a time depending electromagnetic field.

However, FT-ICR requires a parallel high magnetic field (several T or more) through the use of a superconducting magnet, and hence it is high-priced and large-sized. Further, the measurement time required for obtaining one spectrum is from several seconds to 10 seconds, and about 10 seconds is required for the Fourier analysis necessary for obtaining the spectrum. It cannot be said that FT-ICR requiring a total of about several seconds has a good affinity with a liquid chromatography by which one peak occurs in about 10 seconds. Namely, FT-ICR is disadvantageously difficult to use for the high-throughput protein analysis.

If an expensive FT-ICR is not used, and further, high-throughput ECD can be implemented, a high industrial value can be created. For this reason, there have been made some proposals of a method for implementing ECD without using an FT-ICR. Vachet et al., attempted the implementation of ECD by making an electron beam incident into a three-dimensional radio frequency ion trap (see, e.g., R. W. Vachet, S. D. Clark, G. L. Glish: proceedings of the 43rd ASMS conference on Mass Spectrometry and Allied Topics (1995) 1111). However, the incident electrons are heated at a high speed by a radio frequency electric field, and lost in the outside of the ion trap. For this reason, the implementation of ECD has not been reached.

In recent years, the following three methods for implementing ECD without using an FT-ICR have been proposed.

A first method (method A) is the method schematically shown in FIG. 11. A Penning trap static electromagnetic field ion trap composed of a quadrupole static electric field 31 and a static magnetic field 11 is used. A large number of electron beams 29 are trapped in the inside of the Penning trap. The electrons are trapped in the r direction in such a manner as to wind around the line of magnetic force of the static magnetic field 11. Further, the electrons are trapped in the z direction by the z direction component of the static electric field 31. In order to trap electrons having negative charge, the electric potentials on the opposite sides along the z direction are set at a negative potential with respect to the center of the trap. Precursor ions 1 generated at an ion source 16 are made incident as indicated by an arrow 36 upon the electron beams 29 trapped in this manner, and are collided with the electron cloud, thereby to cause the ECD reaction (see, e.g., T. Baba, D. Black and G. L. Glish: 51st ASMS Conference on Mass Spectrometry and Allied Topics, Montreal, Canada (2003) MPK227/ThPJ1 165). The fragment ions generated in the reaction are ejected as indicated by an arrow 37 to be identified by means of a mass analysis means 17.

A second method (method B) is schematically shown in FIG. 12. Precursor ions 1 are trapped in a Penning trap composed of a static magnetic field 32 and a static magnetic field 11. In order to trap positively charged precursor ions, the electric potentials of the opposite sides along the z direction are set at a positive potential with respect to the center of the trap. The precursor ions 1 trapped therein are irradiated with an electron beam 29 (see, e.g., T. Baba, D. Black and G. L. Glish: 51st ASMS Conference on Mass Spectrometry and Allied Topics, Montreal, Canada (2003) MPK227/ThPJ1 165). The electrons reach the precursor ions 1 along the line of magnetic force in such a manner as to wind around the line of magnetic force of the magnetic field (11). The fragment ions generated by the ECD reaction are ejected as indicated by an arrow 37, and identified by means of the mass analysis means 17. In FIGS. 11 and 12, the lines 31 and 32 representing the static electric fields are actual static electric fields, and hence they are shown in solid lines.

A third method (method C) is a method using a three-dimensional radio frequency ion trap as shown in FIG. 13. The electron beam 29 is made incident through a hole made in a ring electrode of the three-dimensional radio frequency ion trap. At this step, a magnetic field 11 is applied in the electron incident direction, so that the electrons are injected to the precursor ions 1 present at the center of the ion trap with high efficiency (see, e.g., I. Ivonin and R. Zubarev: 51st ASMS Conference on Mass Spectrometry and Allied Topics, Montreal, Canada (2003) ThPE057). The fragment ions are analyzed by use of the same three-dimensional radio frequency ion trap, and identified by the ion trap mass spectrometry which is a conventional method.

In FIG. 13, the pseudopotential describing the three-dimensional radio frequency ion trap potential is shown in dotted lines 33. The pseudopotential is the quasi potential formed as the temporal average by the radio frequency electric field, and can be considered with the image described in terms of the static electric field as the approximation. However, in actuality, the effects of the variable electric field occur as micromotion, radio frequency heating, and the like in the movement of the charged particles due to the radio frequency.

The foregoing three methods A, B, and C have been disclosed as the proposals of the principles. At the present time, the ECD reaction has not yet been proved.

SUMMARY OF THE INVENTION

The foregoing three methods A, B, and C respectively have the following problems.

The method of electron capture, ion incidence shown in the method A has a problem that it is difficult to control the reaction time, and to ensure a long time therefor (Problem 1). The reason for this is as follows. The length of time required for the precursor ions 1 to pass through the electron cloud 29 is the reaction time, and hence the reaction time is about 1 millisecond at most. It has also been proposed that the precursor ions are allowed to go to and fro to increase the reaction time. However, the passing efficiency of the ions through the Penning trap is less than 100%, incurring a loss of the ions. It can be pointed out that the shortness of the reaction time makes impossible the implementation of the ECD reaction.

The problem 1 can be solved by trapping the precursor ions 1, and making the electrons 29 incident thereupon. This is the method B or C, which is the method adopted in the FT-ICR. Namely, by trapping the precursor ions, and adjusting the incidence time of the electrons, it is possible to obtain a long reaction time.

However, the method for implementing the ECD shown in the method B has the following problems: the trapping efficiency of the precursor ions 1 upon incidence is low; and for the general low vacuum (about $1\times10^{-2}$ Pa) of the ion trap portion of the ion trap TOF mass spectrometer conventionally used in coupling with a liquid chromatograph, the storage lifetime of the ions is shorter than the length of time required for the ECD reaction (several milliseconds or more) (Problem 2). In FIG. 12, for the purpose of increasing the trapping efficiency of the precursor ions upon incidence, the depth of the electrostatic potential 32 in the z direction is increased, resulting in a loss of the stability in the r direction of the precursor ions. As a result, it is not possible to trap the ions. Whereas, in a low vacuum environment, the precursor ions collide with the residual gas ions in a vacuum, so that the kinetic energy thereof is lost. Upon this, the orbit of the ions circulating around the z axis is enlarged. In other words, the Penning trap cannot retain the ions with stability for a long time in a low vacuum environment.

When the method for applying a weak magnetic field to the three-dimensional radio frequency quadrupole ion trap shown in the method C is used, the problem in the method B is solved. The reason for this is as follows. It is the known fact that the tree-dimensional radio frequency ion trap has a practical ion incidence efficiency. Further, when the stabilizing conditions for the ions are satisfied, the ions are rather converged in the center of the ion trap due to the collision with the residual gas in a vacuum because the center of the ion trap is the minimum point of the potential.

However, with the method C, the three-dimensional radio frequency ion trap is used, and hence the locus of the electrons is applied with a radio frequency electric field, and heating by accelerating or decelerating of the externally incident electrons is unavoidable. Eventually, both HECD (reaction with heated electrons of 5 eV or more) and ECD (reaction by electrons of 1 eV or less) occur according to the phase of the radio frequency electric field upon which the electrons have been made incident. This means that the problem is encountered that it is not possible to significantly control the energy of the electrons which is an important parameter which should be essentially controlled (Problem 3). The problem 3 is insignificant in the methods A and B because a radio frequency electric field is not used.

In summarizing the foregoing problems, there is a demand for a method capable of trapping precursor ions upon incidence with high efficiency, capable of retaining them for a long time even in low vacuum (about $1\times10^{-2}$ Pa), and further capable of controlling the energy of the electrons in a kinetic energy region in the vicinity of 1 eV at a precision of 1 eV or less. When this can be implemented, it becomes possible to effect the reaction with high efficiency, which enables the pursuing of the analysis operation while discriminating between ECD and HECD.

Under such circumstances, it is an object of the present invention to provide a mass analysis technique enabling high efficiency and high-throughput ECD without using an FT-ICR.

In the present invention, a two-dimensional combined ion trap is used as an ion trap means, so that the trapped precursor ions are irradiated with electrons along and in generally parallel with the central axis of the two-dimensional combined ion trap. As a result, the foregoing problems are solved.

The combined ion trap is the ion trap composed of a radio frequency electric field, a static magnetic field, and if required, a static electric field. In the present invention, it is particularly effective to use the two-dimensional combined ion trap.

FIG. 14 shows a principal configuration of the present invention. The two-dimensional combined ion trap is composed of, as schematically shown in FIG. 14, a two-dimensional radio frequency electric field applied in the r direction, a static electric field 35 used for trapping ions in the direction (z direction) in which a radio frequency is not applied, and a static magnetic field. In FIG. 14, the pseudopotential formed by the two-dimensional radio frequency electric field is indicated by dotted lines 34, and the static electric field applied in the z direction is indicated by a solid line 35. The two-dimensional combined ion trap may also be expressed as a linear combined ion trap.

The precursor ions 1 are stored in the two-dimensional combined ion trap, and the electron beam 29 is applied thereto. As a result, the foregoing problem 1 is solved. This is because the long reaction time can be ensured by retaining the ions in the same manner as with the methods B and C.

By using the two-dimensional combined ion trap, the foregoing problem 2 is also solved. The efficiency of trapping the precursor ions 1 in the two-dimensional combined ion trap upon incidence is high. The use of the two-dimensional combined ion trap provides a trapping efficiency of roughly 100%. This is because the depth of the static voltage potential in the z direction can be increased up to the practically usable level without impairing the stability of retention of ions in the r direction. However, when a larger depth than necessary is ensured, the ions become unstable by the action of divergence due to the static voltage in the r direction exceeding the stability in the r direction by the radio frequency. As for the two-dimensional combined ion trap, the magnetic field does not inhibit the injection of ions, but affects the stability of the ions. The conditions required for the stability of the ions will be discussed in Example 1 described later.

Whereas, in the two-dimensional combined ion trap, the central axis of the ion trap is the bottom of the pseudopotential due to the radio frequency electric field. Further, the potential in the z direction due to the static electric field provides the convergent force in the z direction. Therefore, when the ions lose energy by collision with the residual gas in a vacuum, the ions are more converged and retained in the ion trap. Further, in the two-dimensional combined ion trap, a radio frequency is not applied along the z direction in which ions are made injected. Therefore, there is no effect of rebound by a radio frequency in the vicinity of the inlet of the ion trap. For this reason, it is known that the injection efficiency of ions is high (reference literature: J. Am. Soc. Mass Spectrom., 2003, vol. 13, Page 659).

As described above, the injection efficiency into the two-dimensional combined ion trap is high, and the collision with the residual gas in a vacuum acts advantageously for ion retention. As a result, the problem 2 is solved.

By using the two-dimensional combined ion trap, the foregoing problem 3 is also solved. The precursor ions 1 retained in the two-dimensional combined ion trap is applied with the electron beam 29 to effect the ECD reaction. The electrons are injected along the central axis of the two-dimensional combined ion trap with a radio frequency electric field amplitude of zero. As a result, the injection path is not applied with a radio frequency, which can prevent the heating of electrons by a radio frequency electric field. Further, the magnetic field 11 is applied in the direction along and generally in parallel with the central axis of the two-dimensional combined ion trap. By spiral motion of electrons around the magnetic field applied in the direction of the central axis, it is possible to restrict the electron orbit in the vicinity of the central axis. As a result of this, the overlap density of the spatial distribution with the precursor ions is enlarged, and the loss of the electrons due to the radio frequency electric field is inhibited. By setting the adjustment of the intensity of the magnetic field at 0.05 T or more, effective orbit restriction is carried out. The manner in which electrons are injected at about 1 eV without heating inside the two-dimensional combined ion trap will be shown in Example 1 described later. As described above, by injecting electrons along and generally in parallel with the central axis of the two-dimensional combined ion trap, the problem 3 is solved.

The fragment ions generated in the ECD reaction are ejected as indicated by an arrow 37, and identified by means of a mass analysis means 17.

As described above, by using the method in accordance with the present invention, the foregoing problems 1 to 3 can be solved.

Incidentally, in the present invention, the adoptable two-dimensional radio frequency electric fields are radio frequency components of quadrupole, hexapole, octapole, and so on. The use of the two-dimensional quadrupole radio frequency electric field provides the following advantages: the precursor ions can be converged strongly on the central axis; and the device configuration is easy such that the four electrode rods are sufficient. Whereas, by adopting the two-dimensional hexapole radio frequency electric field, or the two-dimensional octapole radio frequency electric field, it is possible to reduce the radio frequency amplitude in the vicinity of the central axis under the conditions for obtaining the same ion trap potential depth for the same mass-to-charge ratio ions as compared with the two-dimensional quadrupole radio frequency electric field. This is advantageous in that the heating effect on electrons can be reduced. The present invention provides both the advantage and simplicity of the convergence possessed by the quadrupole radio frequency and the advantage of the reduction of heating of electrons possessed by the multipole RF as advantages.

In accordance with the present invention, it is possible to implement a mass analysis technique enabling high efficiency and high speed ECD without using an FT-ICR.

DETAILED DESCRIPTION OF THE PREFERRED EMBODIMENTS

Below, the present invention will be described by way of examples with reference to the accompanying drawings.

Example 1

Figure 1:
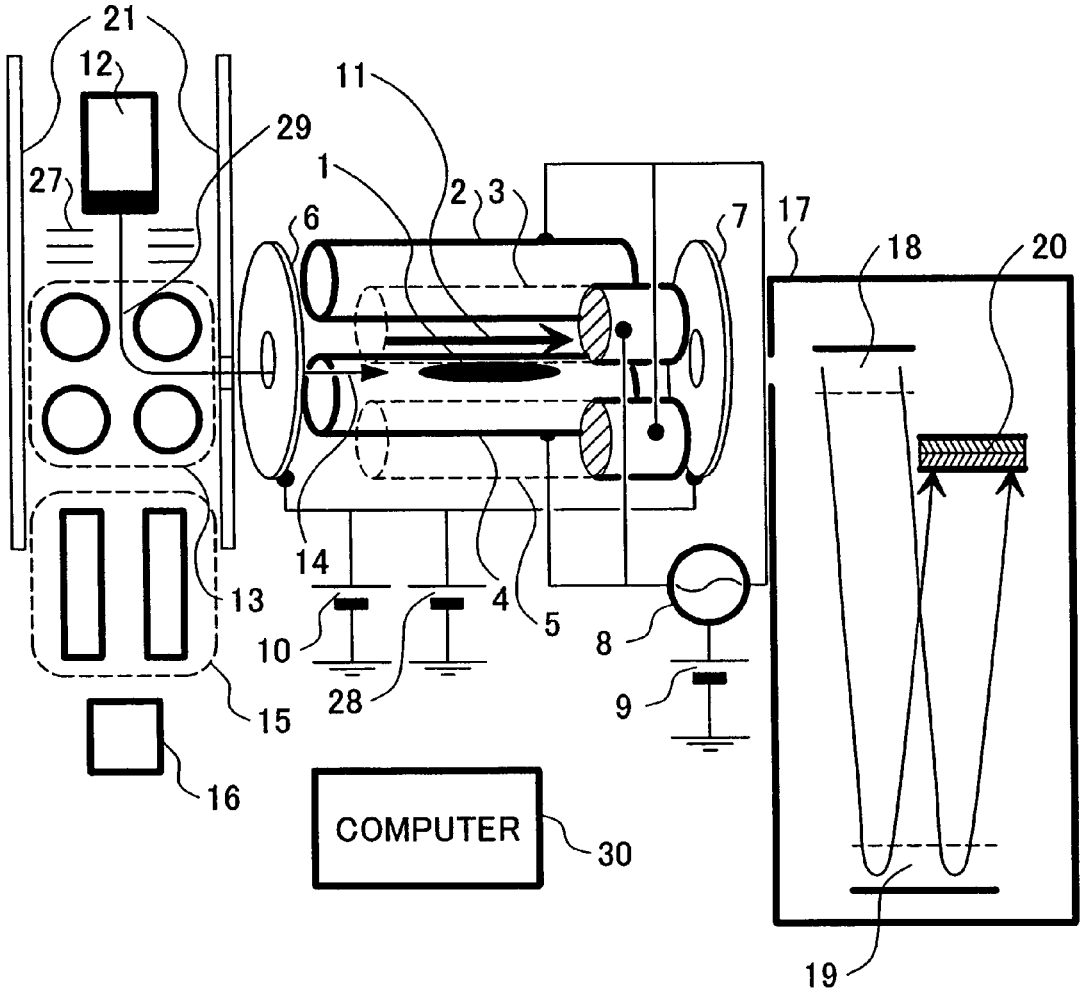
FIG. 1 is a diagram for illustrating a first example of the present invention.

FIG. 1 shows a first example of the present invention. A mass spectrometer capable of carrying out ECD of this example is composed of a reaction cell including a two-dimensional combined ion trap 2 to 11, an electron source unit 12, 13, 21, and 27, and for effecting the electron capture dissociation reaction (ECD reaction), an ion source unit 15 and 16, and a time-of-flight mass analysis unit as a mass analysis means 17. These respective units are controlled by a computer 30. In the diagram, a reference numeral 1 denotes trapped precursor ions.

In this example, as the two-dimensional combined ion trap, the two-dimensional quadrupole electrodes 2 to 5 are used. As illustrated, the electrodes 2 to 5 made of four rods are applied with a radio frequency voltage by using a radio frequency power source 8, so that a radio frequency quadrupole electric field is generated inside the space formed by the rod electrodes (in the diagram, for the electrodes 3 and 5, a portion thereof is indicated by a dotted line for convenience in description). For the two-dimensional quadrupole electrodes 2 to 5, the electrostatic potential thereof is adjusted by using a static voltage power source 9. In order to trap ions in the direction along the central axis, two electrodes, i.e., wall electrodes 6 and 7, applied with a static voltage by using a static voltage power source 10 are disposed. In FIG. 1, the wall electrodes 6 and 7 are each formed with a permanent magnet with a hole opened therein. The line of magnetic force formed by the magnet is indicated by a reference numeral 11. The magnetic circuit is not shown for simplicity. The examples of the two-dimensional combined ion trap including the magnetic circuit will be explained in connection with FIGS. 6, 7, and 8, described later.

For the ion source unit 15 and 16, an electro spray ion source: ESI 16 having a feature of tending to generate multi-charged ions is used. The reaction with electrons is pursued, and hence ESI is required to operate in the mode for generating positive electric charges. ESI is a common technique, and hence a detailed description thereon is herein omitted. At the subsequent stage of the ion source 16, a mass analysis means 15 such as a Q mass filter or a two-dimensional radio frequency ion trap mass analysis unit is disposed. Herein, the isolation for enhancing the purity of the precursor ions, and precursor scan are carried out.

The electron source unit 12, 13, 21, and 27 is composed of an electron source 12, a quadrupole deflector 13, an electrostatic lens 27, and a magnetic shield box 21. As the electron source 12, a dispenser cathode capable of generating a large current is used. The generated electron beam is converged by the use of the electrostatic lens 27, and guided along the central axis of the two-dimensional combined ion trap to the central part thereof.

If the dispenser cathode and the electrostatic lens described above are set in the proximity of the inlet or outlet portion of the two-dimensional combined ion trap, it becomes impossible to cause the incidence of precursor ions and the ejection of fragment ions. Therefore, in order to avoid this problem, the quadrupole deflector 13 is set. When the quadrupole deflector 13 is set, it is possible to ensure a total of three directions of injection of charged particles. Various combinations of the positions at which the electron source and the ion source are sited are conceivable. In this example, there has been shown an example in which electrons and precursor ions are injected from the direction at 90 degrees with respect to the direction of incidence into the two-dimensional combined ion trap. The orbit of electrons may be largely affected by the leakage magnetic field of the two-dimensional combined ion trap. In order to avoid the adverse effect, the portions of the electron source 12 and the quadrupole deflector 13 are accommodated in the magnetic shield box 21.

In this example, the fragment ions are subjected to high resolution mass analysis by using the time-of-flight mass analysis means 17. In this example, a time-of-flight mass analysis unit having a V-shaped flight path, including a reflectron 19 is used. The ions accelerated at an acceleration portion 18 are reflected by the reflectron 19, and counted at a multichannel ion detector 20. In the present invention, the ECD process does not depend upon the details of the time-of-flight mass spectrometer 17, and hence a detailed description of TOF mass spectrometer is omitted.

Figure 6:
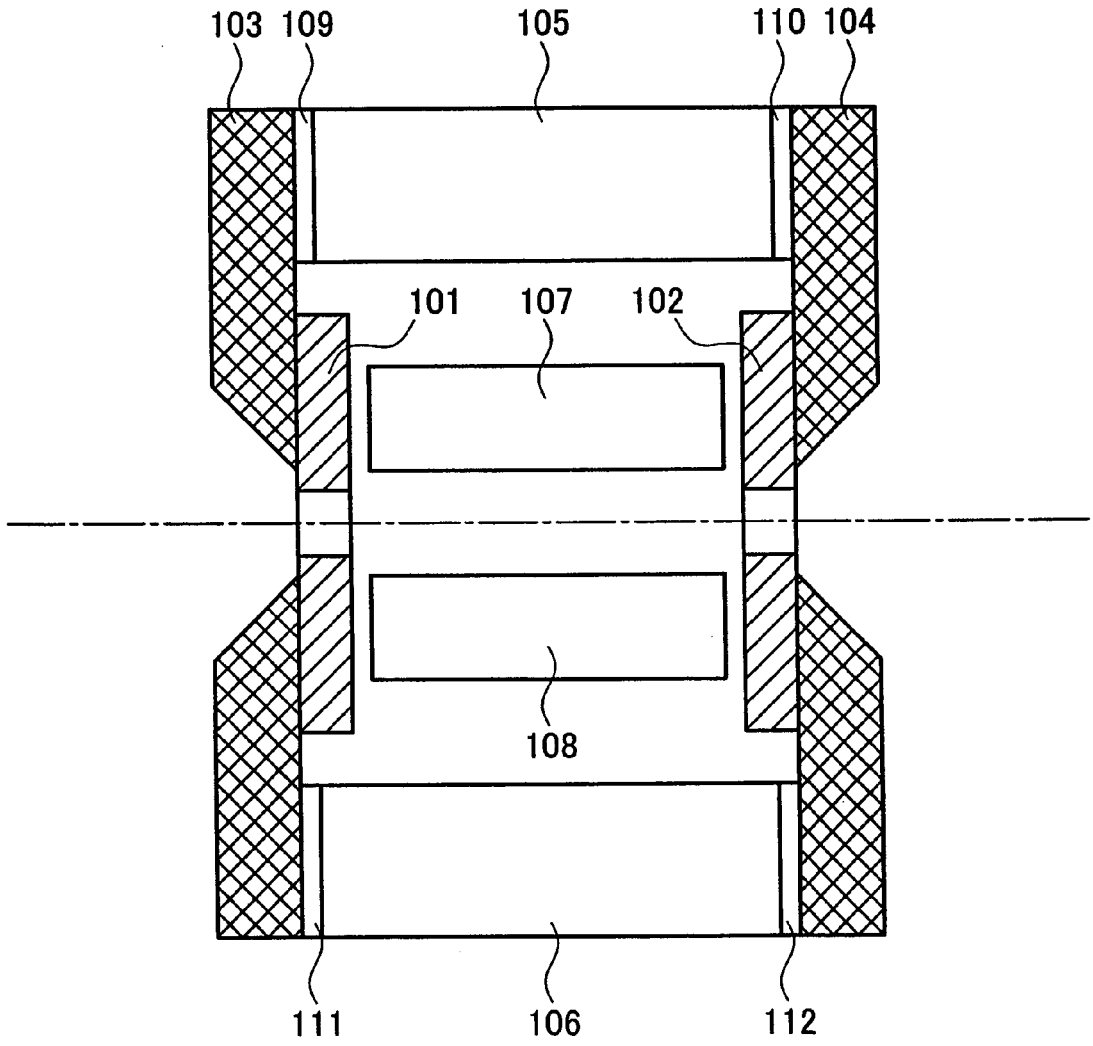
FIG. 6 is a cross sectional view showing one example of a magnetic circuit constituting a two-dimensional combined ion trap.
Figure 7:
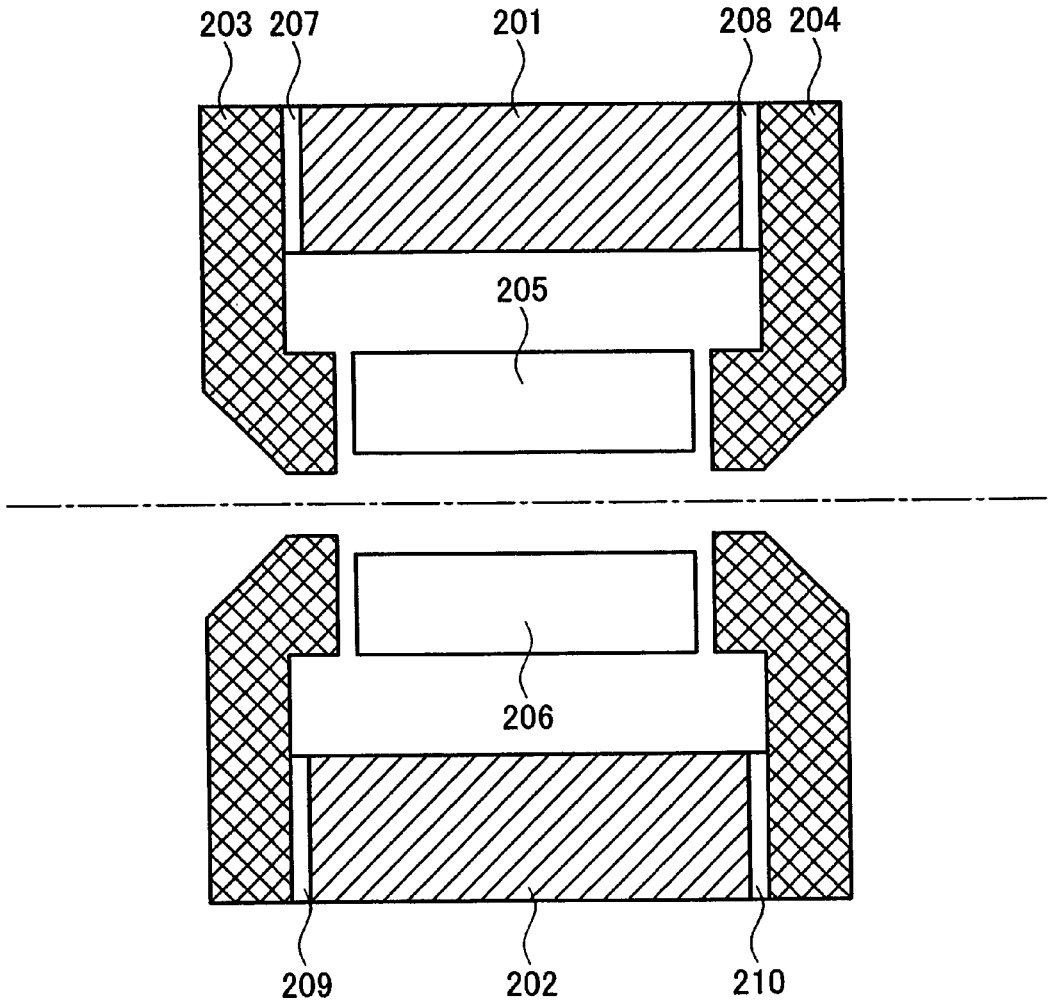
FIG. 7 is a cross sectional view showing another example of the magnetic circuit constituting a two-dimensional combined ion trap.
Figure 8:
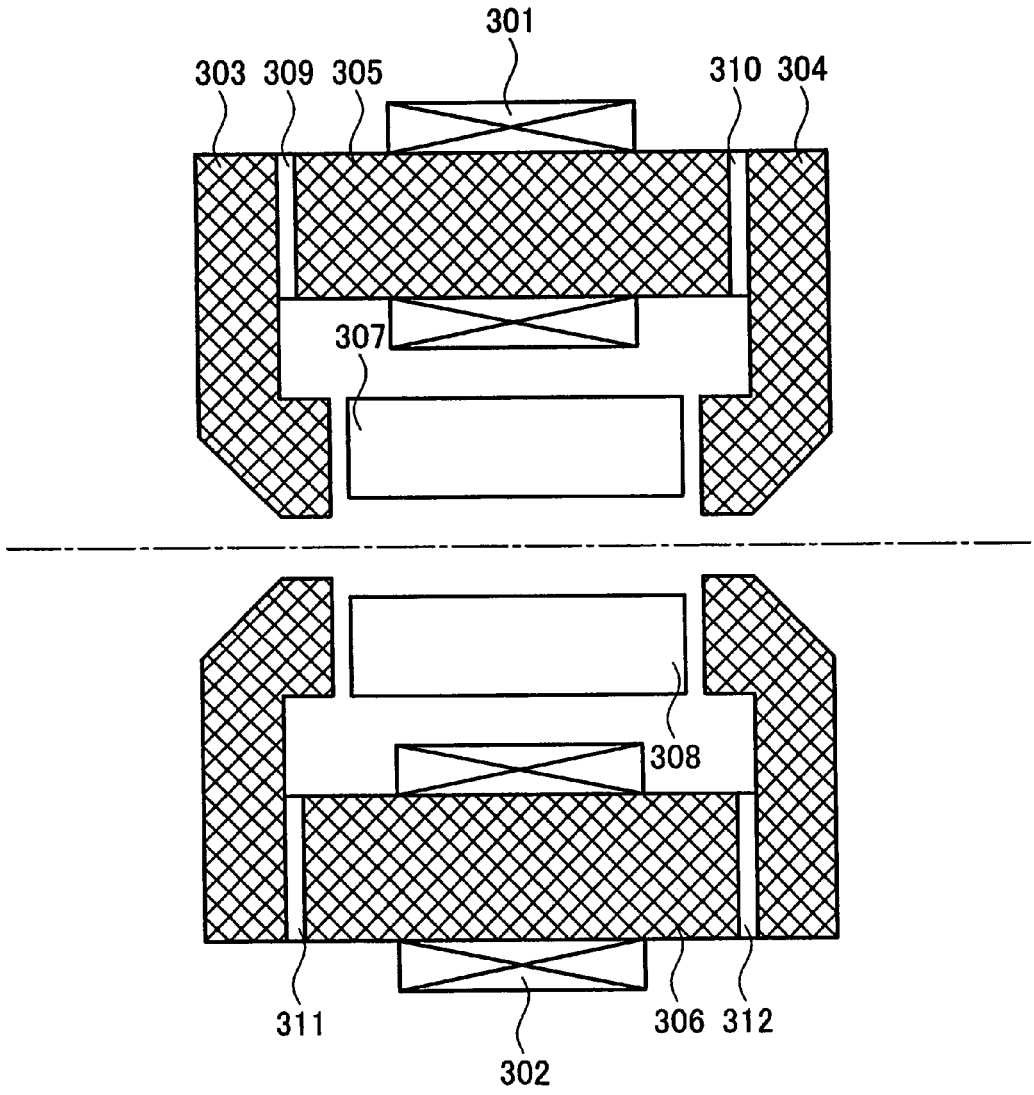
FIG. 8 is a cross sectional view showing a still other example of the magnetic circuit constituting a two-dimensional combined ion trap.

FIGS. 6 to 8 show examples of the two-dimensional combined ion trap. Every example is shown in a cross section cut along the plane including the central axis of the two-dimensional combined ion trap.

FIG. 6 is one example of a magnetic circuit constituting the two-dimensional combined ion trap. This diagram shows the two electrodes 107 and 108 out of the quadrupole electrodes made up of four electrode rods to be applied with a radio frequency voltage. The magnetic field is generated by using the hollow plate-like permanent magnets 101 and 102. By using the magnetic circuits 103 to 106 manufactured with a soft magnetic iron, the magnetic flux outside the quadrupole electrodes 107 and 108 is confined. This aims to minimize the residual magnetic field on the orbit of the electron beam 29 generated at the electron beam source 12, and passing through the electrostatic lens 27 and the quadrupole deflector 13 by the leakage magnetic field. The magnetic flux density of the central portion of the two-dimensional combined ion trap is roughly equal to, or slightly weaker than the magnetic flux density produced by the permanent magnets 101 and 102. When a neodymium-iron-boron magnet is used as a permanent magnet, it is possible to generate a magnetic flux density of about 0.1~1 T. Whereas, this kind of magnet has electric conductivity, and hence it can be used as a wall electrode as it is. In order to enable the permanent magnets 103 and 104 which are wall electrodes to be independently applied with a static voltage, insulators 109 to 112 are inserted.

FIG. 7 is another example of the two-dimensional combined ion trap in which the permanent magnets have been removed from the wall electrode portions. This diagram shows two (205 and 206) out of the quadrupole electrodes made up of four electrode rods to be applied with a radio frequency voltage. In FIG. 7, reference numerals 201 and 202 denote permanent magnets each in the shape of a cylinder. This is effective when the magnet having no electric conductivity (such as ferrite) is used. Whereas, the example of FIG. 6 has a simple configuration, but it is difficult to adjust the magnetic flux density or to design it to a given value. In the example of FIG. 7, by adjusting the number of cylinders of the permanent magnets, it becomes possible to adjust the magnetic flux density at the central portion of the two-dimensional combined ion trap. By using soft magnetic iron with a small magnetic permeability and a large saturation magnetization for magnetic poles 203 and 204, it is possible to converge the magnetic fluxes, and to apply an intense magnetic field to the central part of the two-dimensional combined ion trap. In order to enable the magnetic poles 203 and 204 operating as the wall electrodes to be independently applied with a static voltage, insulators 207 to 210 are inserted.

FIGS. 6 and 7 described above each show a device configuration which does not require a power source for generating an electric field by using permanent magnets.

FIG. 8 is another example of the two-dimensional combined ion trap using normal conductive electromagnets. There may arise a demand for the arbitrary change of the intensity of the magnetic field as a parameter in practicing. In such a case, a normal conductive electromagnet is used in place of the permanent magnet of FIG. 7. Coils 301 and 302 are wound around magnetic cores 305 and 306, respectively, thereby to generate magnetic fields. The generated magnetic fields are applied to two-dimensional quadrupole electrodes 307 and 308 via the magnetic cores 303 and 304, respectively. In order to allow the magnetic poles 303 and 304 operating as the wall electrodes to be independently applied with a static voltage, is insulators 309 to 312 are inserted. In this example, there is an advantage that the intensity of the magnetic field can be made variable. However, a power source (not shown) for operating the electromagnet and a heat-dissipating system become necessary, resulting in a somewhat complicated device configuration.

The three magnetic circuits illustrated above respectively have advantages and disadvantages, and hence these are selected according the needs. In the example configured in FIG. 1, there is adopted the system in which the hollow permanent magnets of FIG. 6 are disposed at the opposite sides of the two-dimensional quadrupole electrodes. However, the magnetic circuit and the insulator are not shown.

The optimum intensity of the static magnetic field to be applied to the two-dimensional combined ion trap depends upon the size of the quadrupole electrodes, the rf frequency, the mass of the precursor ion, and the maximum/minimum mass-to-charge ratio of the fragment ions. It is realistic to design the device with reference to the results introduced from the ion orbit calculation by a computer. The shape of the two-dimensional combined ion trap of a typical size as shown below is specified, and an example of magnetic field determination will be shown.

The size of the quadrupole electrodes (the distance between the central axis of the ion trap and the electrodes: ro) is set at 10 mm; the rf frequency, 1 MHz; the maximum mass-to-charge ratio of the precursor ion targeted for analysis, 1000 [Da]; and the minimum mass-to-charge ratio of the fragment ion, 100 [Da]. The conditions under which the ions are retained inside the reaction cell with stability are shown in FIGS. 2 to 5. Below, Vrf denotes the rf amplitude; Ω, rf frequency; Vdc, the wall electrode voltage; a, the length of the two-dimensional quadrupole electrodes; and B, the magnetic flux density. Further, m denotes the mass of the ion; and Ze, the charge thereof.

Figure 2:
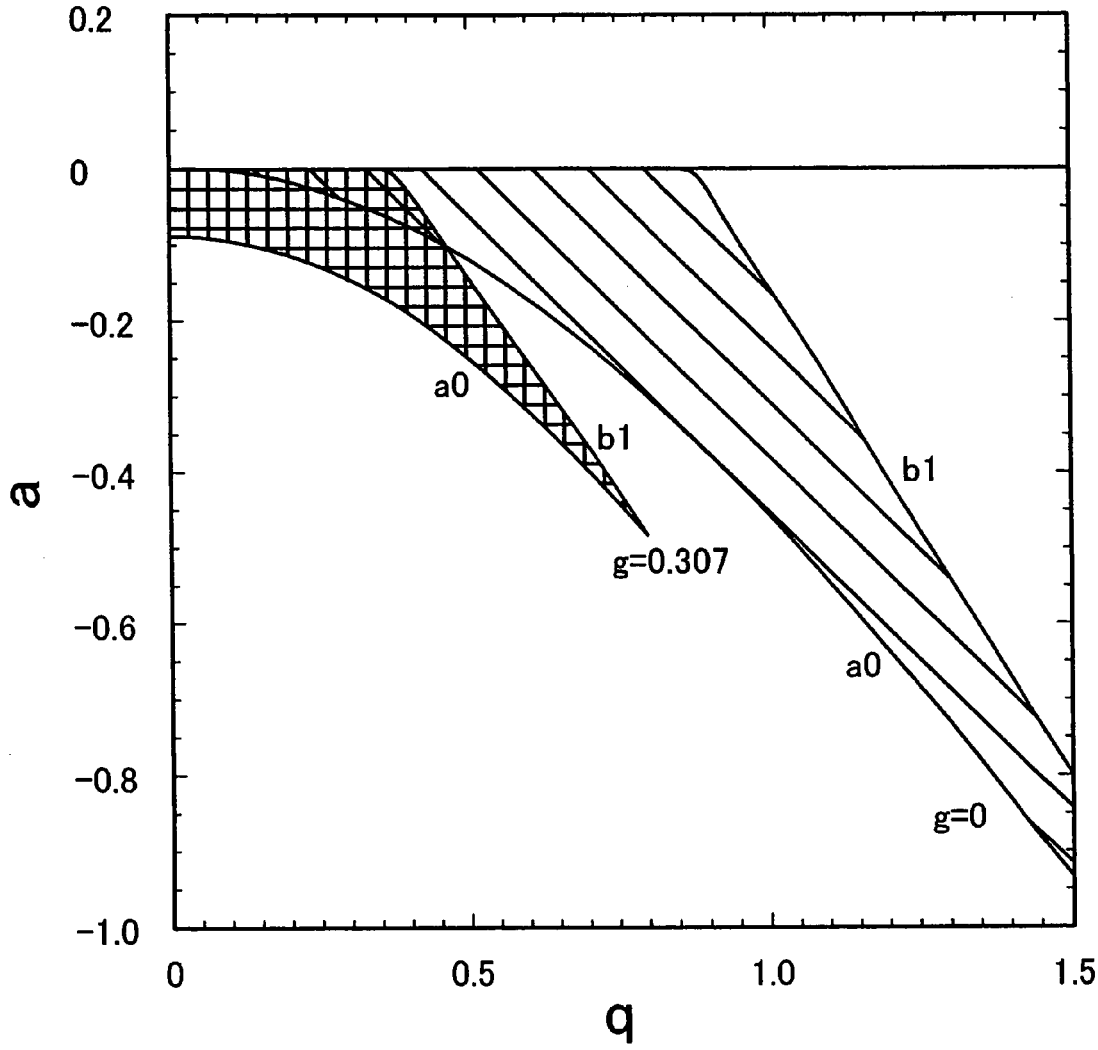
FIG. 2 is a diagram showing a stable region (1) of ions.
Figure 3:
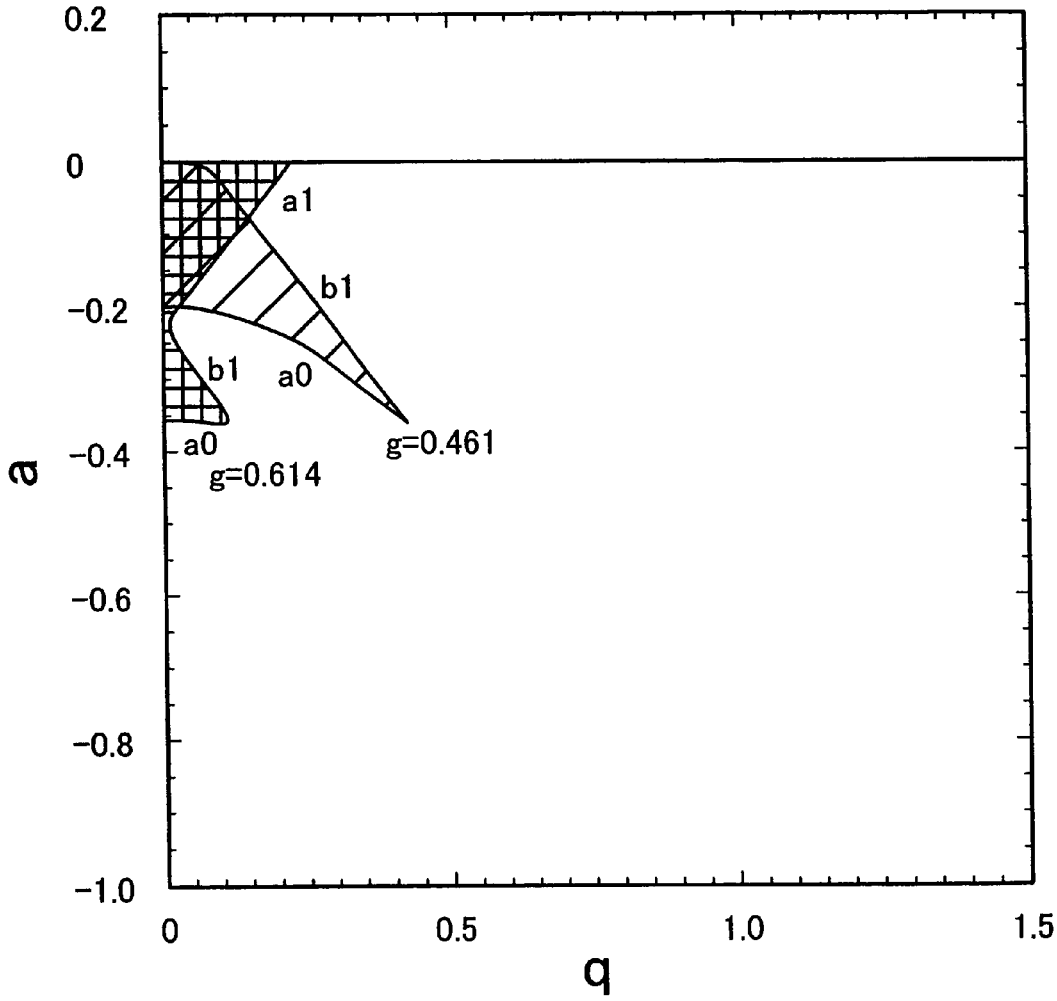
FIG. 3 is a diagram showing a stable region (2) of ions.

In FIGS. 2 and 3, the rf amplitude, the wall electrode voltage, and the magnetic flux density are each expressed in the normalized form. The normalized rf amplitude: q, the normalized wall electrode voltage: a, and the normalized magnetic flux density: g are defined as follows:

[Expression 1]

$$q = \frac{2ZeVrf}{mr_0^2\Omega^2} \quad \text{(Expression 1)}$$

[Expression 2]

$$a = \frac{4ZeVdc}{mr_0^2\Omega^2} \quad \text{(Expression 2)}$$

[Expression 3]

$$g = \frac{ZeB}{m\Omega} \quad \text{(Expression 3)}$$

In FIGS. 2 and 3, when the magnetic flux density: g is given, the rf amplitude: q and the wall electrode voltage: a at which ions reside in the two-dimensional combined ion trap with stability are shown by hatching. The parameters: g, q, and a have the mass-to-charge ratio dependence. Therefore, by converting FIGS. 2 and 3 utilizing (Expression 1) to (Expression 3), it is possible to discuss the stability conditions for the ions having a specific mass-to-charge ratio.

The vacuum pressure of the vacuum vessel in which the two-dimensional combined ion trap is set is assumed to be about $10^{-2}$ Pa. in which ions lose the kinetic energy due to the collision between the ions and the gas. Under the conditions, even when a magnetic field is applied, out of the boundary lines for defining the stability region of the ions, the line a0 is equal to the case where g=0. The line b1 is not affected by the degree of vacuum.

Referring to FIGS. 2 and 3, by selecting the magnetic flux density to be 2.0 T or less, it is possible to obtain the conditions for trapping the ions having a mass-to-charge ratio of 100 to 1000 [Da] with stability. When the magnetic flux density exceeds 2.0 T, the ions having a mass-to-charge ratio: 100 [Da] are affected by the resonance due to the radio frequency electric field, and become unstable.

Figure 4:
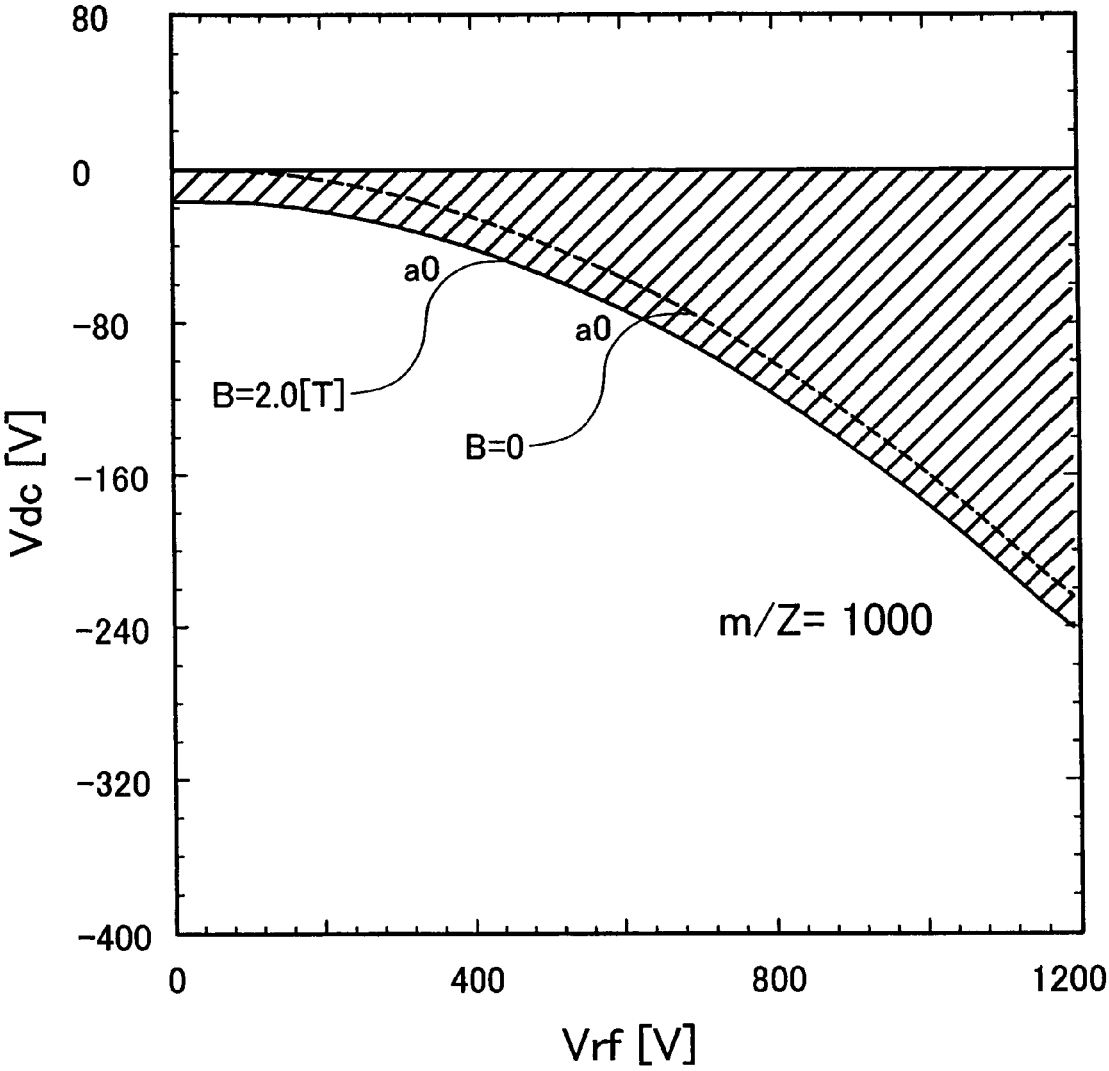
FIG. 4 is a diagram showing a stable region (3) of ions.
Figure 5:
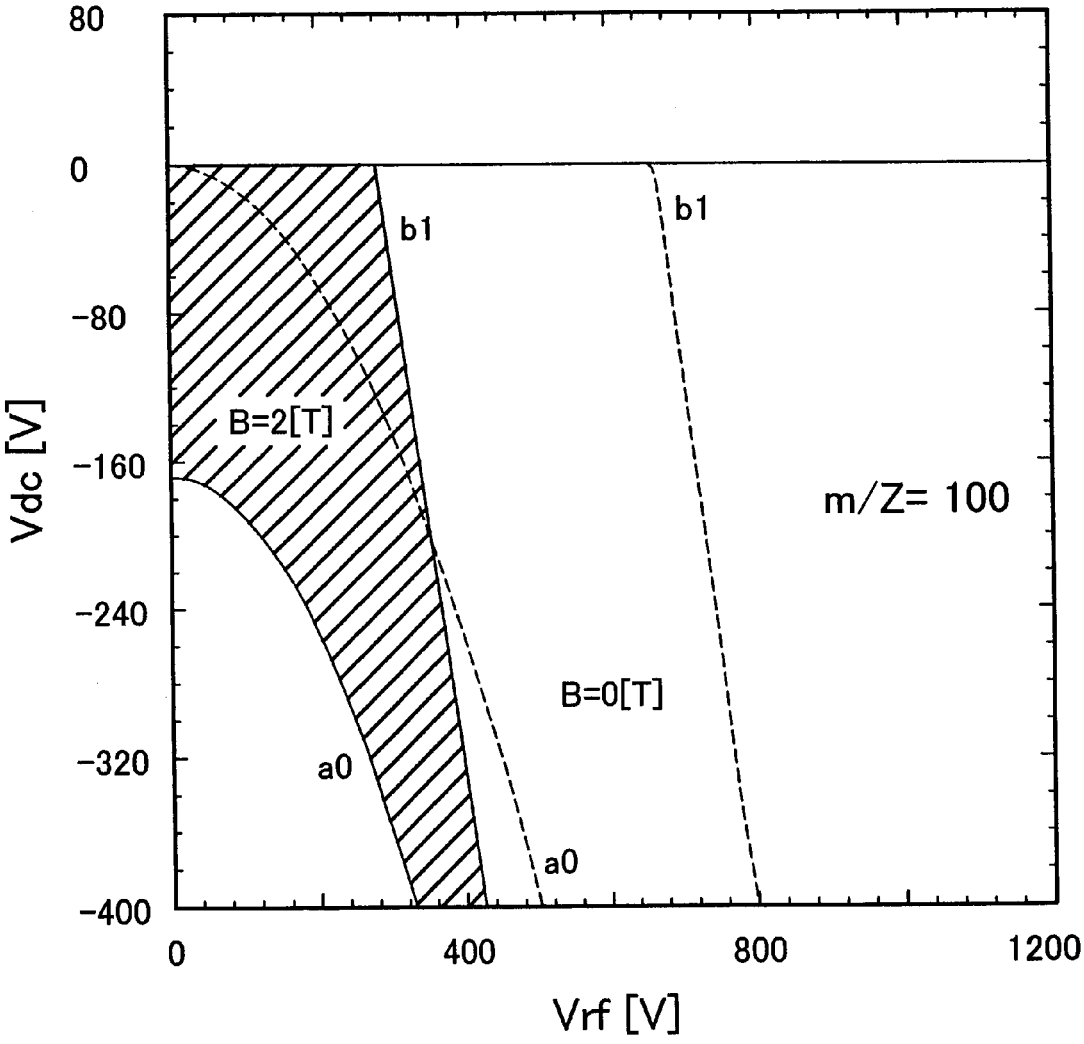
FIG. 5 is a diagram showing a stable region (4) of ions.

FIG. 4 shows the stability region of the ions having a mass-to-charge ratio (m/Z): 1000 [Da]; and FIG. 5, a mass-to-charge ratio (m/Z): 100 [Da]. These diagrams show the case of the magnetic flux density of 0 and the case of 2.0 T, respectively.

The conditions capable of simultaneously retaining the ions with a mass-to-charge ratio (m/Z): 1000 [Da] and the ions with a mass-to-charge ratio (m/Z): 100 [Da] are determined in the following manner.

Namely, the region surrounded by the line a0 (B=0) (in the diagram, which is shown in a dotted line) and the line b1 (B=2.0) (which is in the region that cannot be shown, and hence omitted) of the ions with a mass-to-charge ratio (m/Z): 1000 [Da], and the line a0 (B=0) and the line b1 (B=2.0) of the ions with a mass-to-charge ratio (m/Z): 100 [Da] shows the conditions capable of simultaneously trapping the ions with a mass-to-charge ratio (m/Z): 100 to 1000 [Da]. During the period in which the ECD reaction is carried out, the rf amplitude and the wall electrode voltage for providing the stability region are applied.

In order to restrict the orbit of the electrons around the line of magnetic force, and for low-temperature electrons of about 1 eV to reach the center of the ion trap without being heated by a radio frequency electric field, the intensity of the magnetic field is required to be set at 0.05 T or more. In the following, the results of the computer simulation on the movement of electrons will be shown.

FIGS. 17 to 21 each show the energy distribution of electrons incident from the outside of the two-dimensional combined ion trap along the central axis, calculated by using a computer. For calculation, electrons have been ejected with an energy of 0.2 eV in parallel with the central axis at a probabilistically uniform plane distribution determined by random numbers within a circle with a radius of 1 mm around the central axis in a plane at a distance of 5 mm from the wall electrode. The orbits of a large number of the electrons are tracked. Thus, each diagram shows the distribution of kinetic energy of the electrons when the electrons have reached the central plane (z=0) of the ion trap. The phase of the radio frequency electric field is given by a random number at an equal probability. The electric potential of the electron-ejecting plane is set at −1 V; the wall electrode voltage, 5 V; and the ion trap radio frequency voltage, 100V. The electric potential spatial distribution was determined by numerically solving the Laplace equation.

Figure 17:
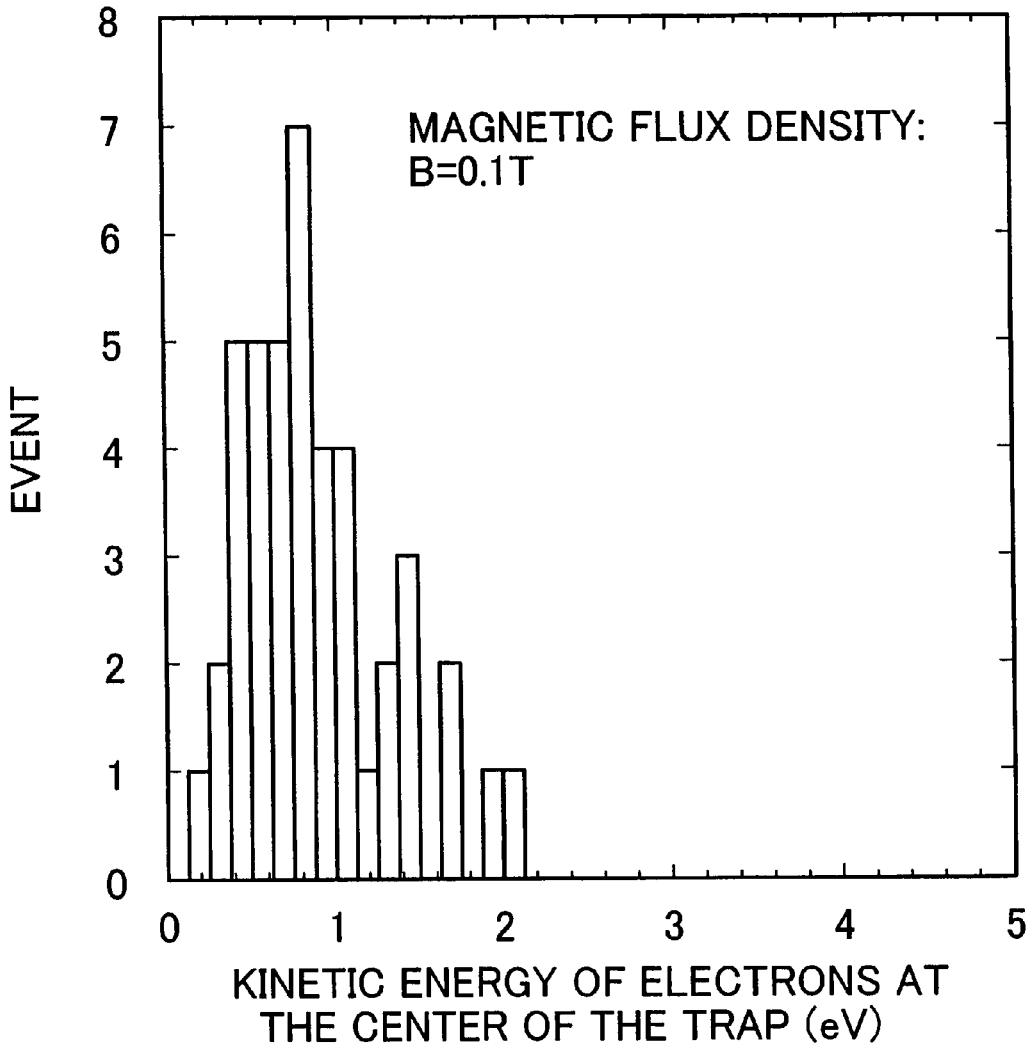
FIG. 17 is a diagram showing the energy distribution of electrons at the center of a two-dimensional combined ion trap, determined from calculation, when the magnetic field of the combined ion trap is 0.1 T.

FIG. 17 shows the results, determined from calculation, of the distribution of energy of electrons at the center of the two-dimensional combined ion trap when the intensity of the magnetic field of the combined ion trap is 0.1 T. As a result of 50 iterations of the trial, there were two trials lost due to the collision with the electrode. The probability leading to the ion distribution in the trap is calculated to be 96±3%. The average value of the energy distribution of the electrons was found to be 0.89 eV, and the standard deviation of the distribution was found to be 0.42 eV. Almost no radio frequency phase dependence was observed. As described above, it is indicated that the use of the method of the present invention enables the discrimination between the ECD reaction and the HECD reaction not implementable in the conventional example using a three-dimensional combined ion trap (Non-Patent Document 3).

Figure 18:
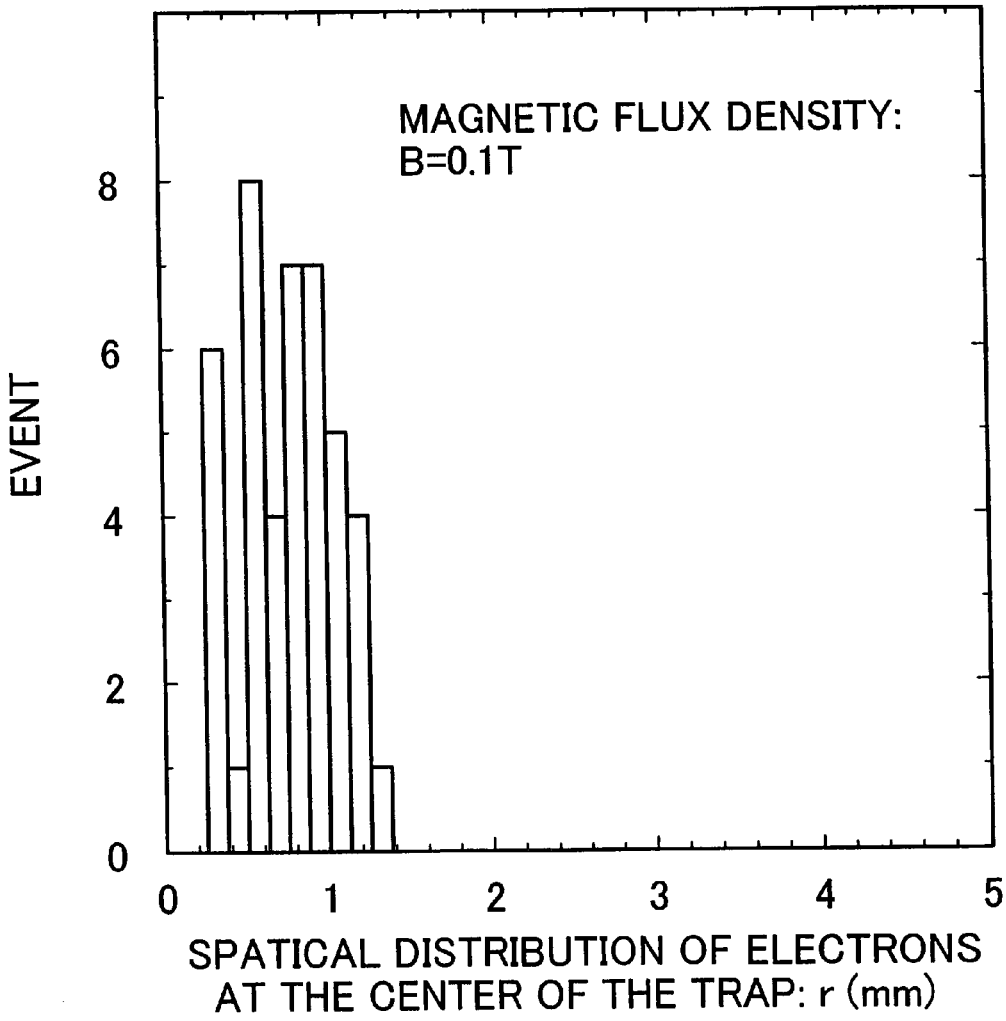
FIG. 18 is a diagram showing the spatial distribution along the r direction of electrons at the center of a two-dimensional combined ion trap, determined from calculation, when the magnetic field of the combined ion trap is 0.1 T.

Whereas, FIG. 18 shows the results, determined from calculation, of the spatial distribution along the r direction of electrons at the center of the two-dimensional combined ion trap when the intensity of the magnetic field of the combined ion trap is 0.1 T. The distance from the central axis of the ion trap within the plane z=0 is shown. The average distance is 0.78 mm, and the standard deviation is 0.28 mm. The spatial distribution of the precursor ions is estimated to be about 1 mm, and hence the sufficient overlapping space between both is obtained.

As shown in FIGS. 17 and 18, it was possible to show that, for the intensity of the magnetic field of 0.1 T, when electrons are made incident along the central axis of the ion trap in such a manner as to be wound around the magnetic field, it is possible to introduce an electron beam of roughly 1 eV and to effect the ECD reaction. Further, it was possible to show as follows. The distribution width of the electron energy is smaller than 1 eV, and hence it is possible to control the electron energy in such a manner as to enable the control of the difference between ECD and HECD.

Figure 19:
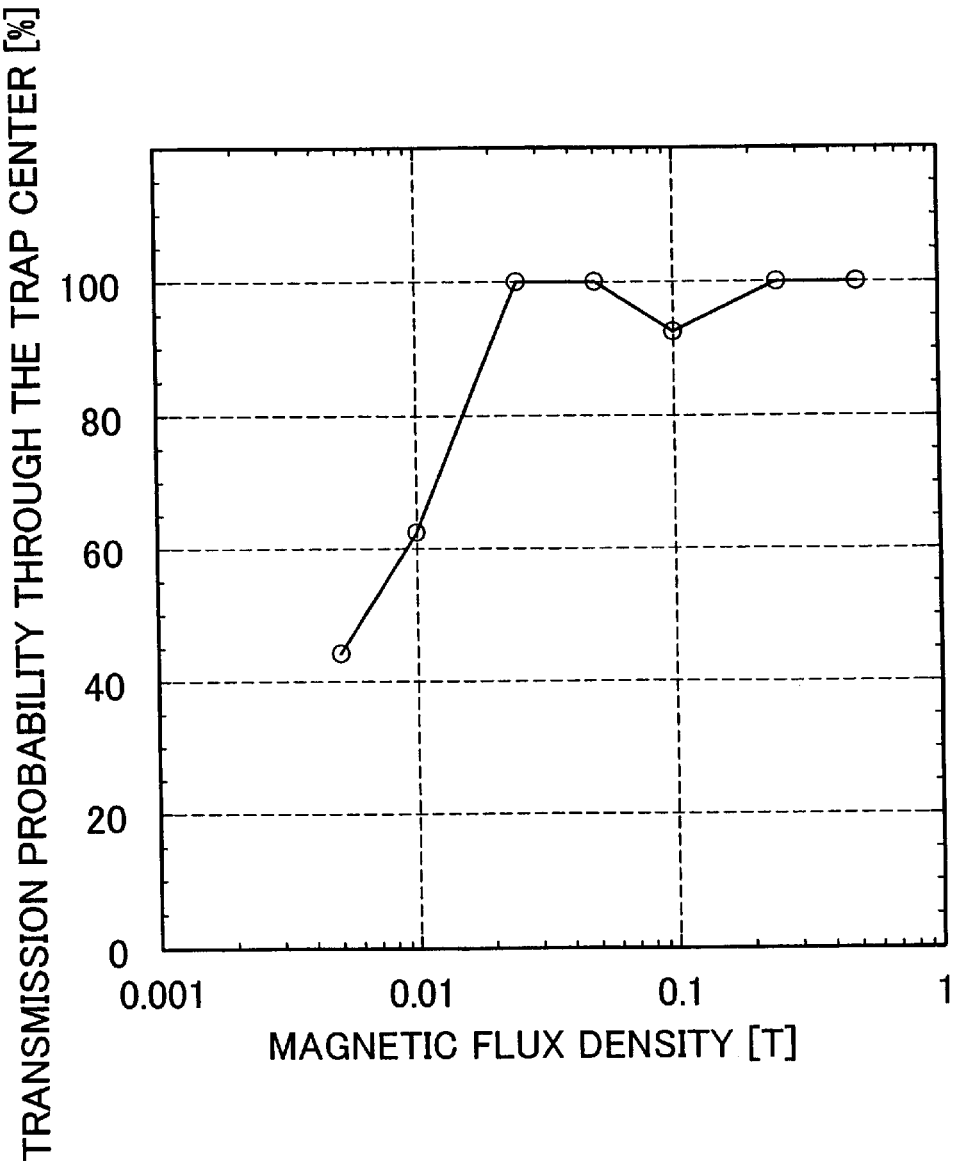
FIG. 19 is a diagram showing the relationship between the probability that electrons can transmit through the center of the two-dimensional combined ion trap and the magnetic flux density, determined from calculation.
Figure 20:
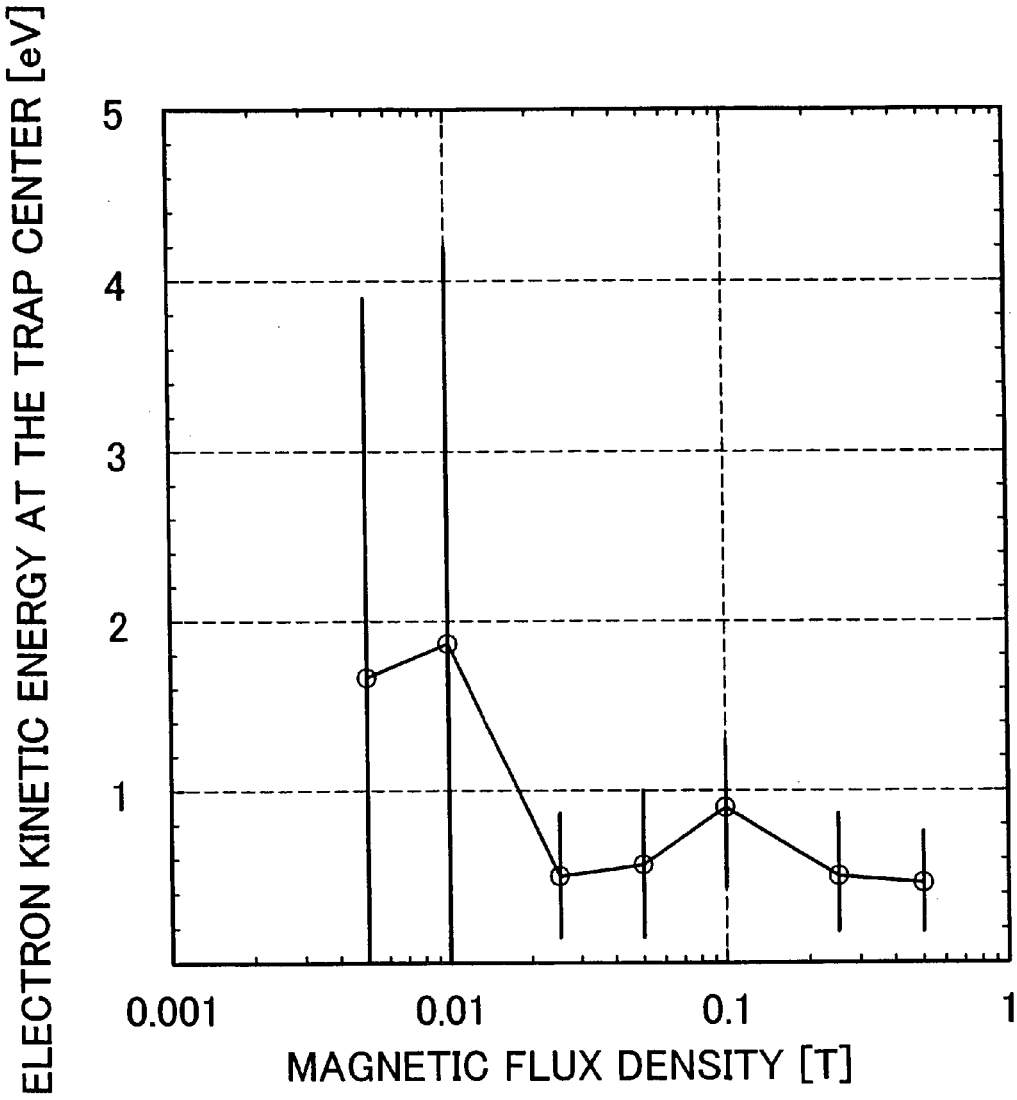
FIG. 20 is a diagram showing the relationship between the electron energy at the center of the two-dimensional combined ion trap and the magnetic flux density, determined from calculation.
Figure 21:
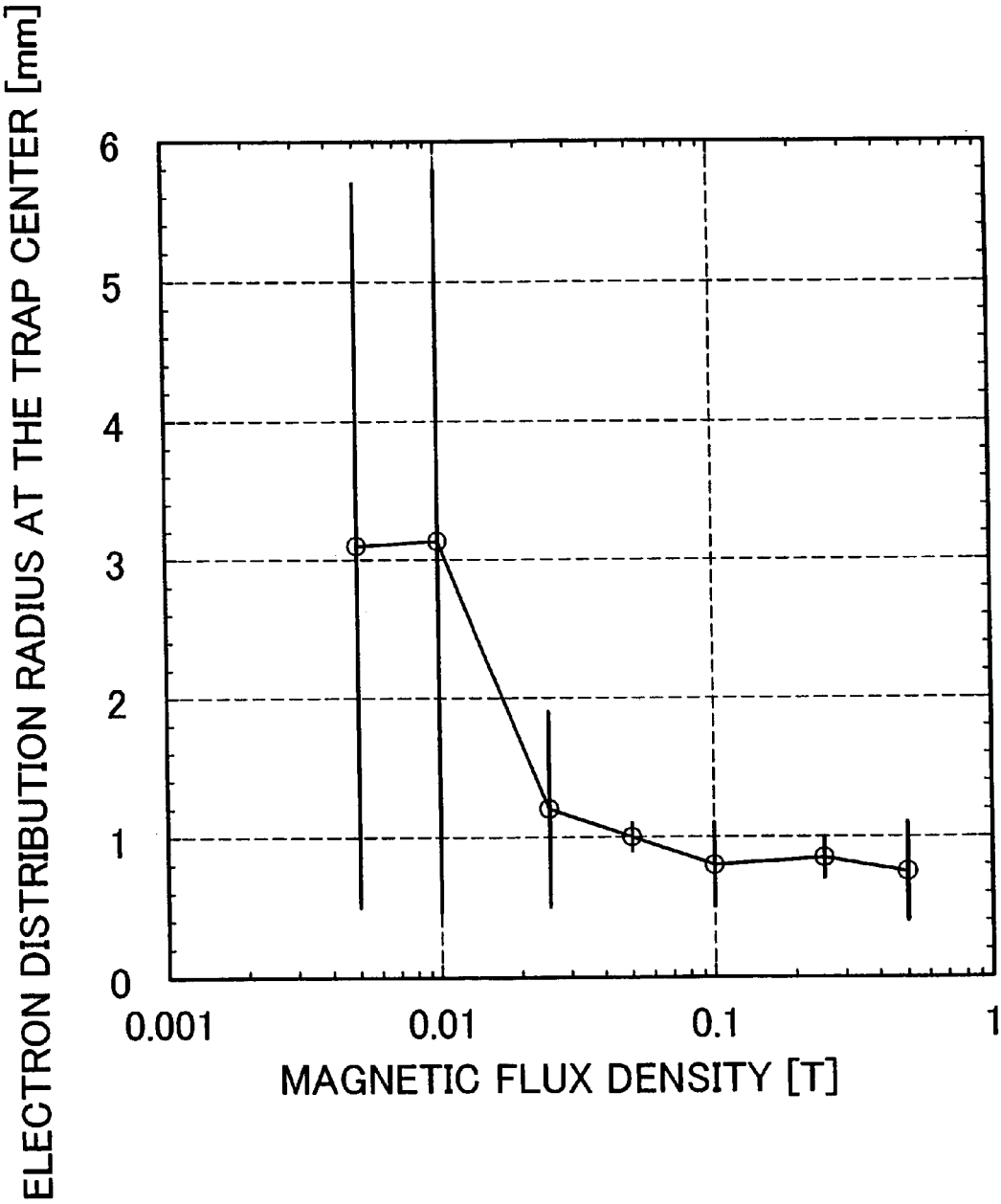
FIG. 21 is a diagram showing the relationship between the spatial distribution along the r direction of electrons at the center of the two-dimensional combined ion trap and the magnetic flux density, determined from calculation.

Subsequently, the behavior of electrons with respect to the intensity of the magnetic field will be discussed. At this step, at the intensity of the magnetic field of B=0, there is no trial in which the center z=0 of the ion trap is reached. Thus, FIGS. 19, 20, and 21 show the results for B=0.005 T or more. Whereas, when B=1 T or more, the frequency of the orbital motion, i.e., the synchrotron motion of electrons due to the magnetic field is large. Therefore, the calculation step becomes too small, and hence the calculation cannot be achieved in a realistic length of time. For the intense magnetic field of more than B=1 T, the winding of the electrons around the line of magnetic force is sufficiently intensified, so that loss or heating of electrons tends to be less likely to occur. At 0.1 to 0.5 T, the sufficient performances can be obtained. Accordingly, it is conceivable that the controllability of electrons will not be lost at the equal or more intense magnetic field.

FIG. 19 is a diagram, determined from calculation, of the relation between the probability that electrons can reach the center of the two-dimensional combined ion trap and the intensity of the magnetic field. The proportion of the electrons which have reached the ion trap center z=0 is expressed in percentage. The trial in which the center is not reached is lost due to the collision with the radio frequency quadrupole electrode rods. It is shown that roughly 100% reaching efficiency can be obtained at the intensity of the magnetic field of 0.02 T or more.

FIG. 20 is a diagram, determined from calculation, of the relationship between the electron energy at the center of the two-dimensional combined ion trap and the intensity of the magnetic field. As for the event in which no collision with the radio frequency quadrupole electrode rod occurred, at z=0, the average kinetic energy is indicated with a circle, and the width of the distribution (standard deviation) is indicated with a solid line. It is indicated that, at the intensity of the magnetic field of 0.02 T or more, it is possible to allow electrons to reach the center of the trap with 1 eV which is an energy required for the ECD reaction without being accelerated by the radio frequency electric field.

FIG. 21 is a diagram, determined from calculation, of the relationship between the spatial distribution along the r direction of electrons at the center of the two-dimensional combined ion trap and the intensity of the magnetic field. As for the events in which no collision with the quadrupole electrode rod occurs, the radius around the central axis of the trap as its center at z=0 is shown. The average value of the radius at each value of the intensity of the magnetic field is indicated with a circle, and the width of the distribution (standard deviation) is indicated with a solid line. It is shown that the distribution radius of the electrons can be set to be 1 mm at the intensity of the magnetic field of 0.05 T or more. This radius is equal to the typical precursor ion distribution radius. In other words, it is possible to sufficiently ensure the superposition of distributions of the precursor ions and the electrons at the intensity of magnetic field of 0.05 T.

Up to this point, by reference to FIGS. 19, 20, and 21, it has been shown that, in order for electrons of about 1 eV to be injected to the center of the two-dimensional combined ion trap without heating, the overlapping portion of FIGS. 19, 20, and 21, i.e., application of the magnetic field of 0.05 T or more is effective.

Figure 15:
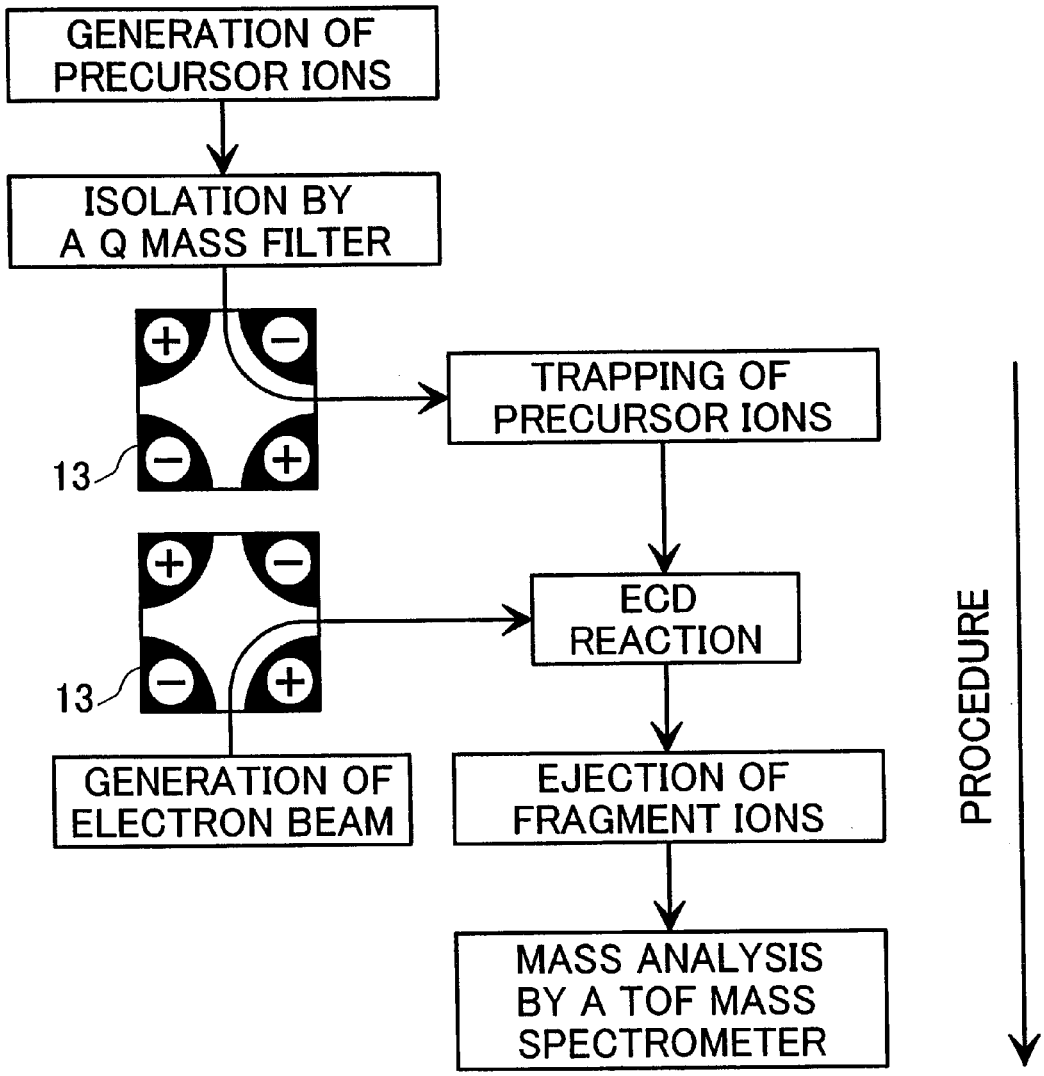
FIG. 15 is a diagram for illustrating the operation procedure in the first example of the present invention.

Then, the operation procedure of this example will be described by reference to FIGS. 1 and 15. First, precursor ions are generated at an ESI ion source 16. The generated ions are injected in a vacuum through capillaries. In order to keep the degree of vacuum of the Q mass filter unit 15, the ions are injected into the Q mass filter unit 15 by using an ion optics including differential pumping. Herein, the ions having a noteworthy specific mass-to-charge ratio are selected as the precursor ions. The selected precursor ions are stored in the two-dimensional combined ion trap via the quadrupole deflector 13. The ions injected in this manner are the precursor ions 1 in FIG. 1. In order to retain the ions, an ion trap radio frequency voltage is applied to the quadrupole electrodes 2 to 5 by using the radio frequency power source 8. Whereas, the wall electrodes 6 and 7 are allowed to have a positive potential relative to the quadrupole electrodes 2 to 5. To this end, the DC voltage sources 10 and 28 are used.

The trapped precursor ions 1 are irradiated with an electron beam 14 to effect the ECD reaction. The dispenser cathode 12 is applied with a heater current, and heated. A voltage is applied between the dispenser cathode 12 and the electron lens unit 27, so that thermal electrons are emitted from the dispenser cathode 12. The electrons are deflected by the quadrupole deflector, and injected into the two-dimensional combined ion trap. The flow of the electrons is indicated by an arrow 29 in FIG. 1. The energy of the electrons involved in the ECD reaction is determined by the ion trap voltage defined by the dispenser cathode 12 and the DC power source 9. Therefore, the potential difference between both is set to be 1 V. During the reaction period out of the operation for effecting the ECD reaction, the radio frequency voltage is set to be minimum as long as retaining of the precursor ions/fragment ions are possible. This is for avoiding heating due to the radio frequency of the electrons 29. The fragment ions are retained inside the combined ion trap.

Upon completion of the ECD reaction, such a gradient of electric field as to eject the ions toward the TOF mass analysis means 17 along the central axis of the two-dimensional combined ion trap is formed in the quadrupole voltage by using the DC voltage sources 9, 10, and 28. As a result, an ion group including the fragment ions is injected to the TOF mass analysis means 17. The injected ions are accelerated by a pusher 18, and the ions are detected at a multichannel plate detector 20 via a reflectron 19. From the time difference between the time at which the ions were accelerated by the pusher 18 and the time at which the ions were detected by the multichannel plate detector 20, the mass-to-charge ratio of the ions is calculated to identify the fragment ions.

Example 2

Figure 9:
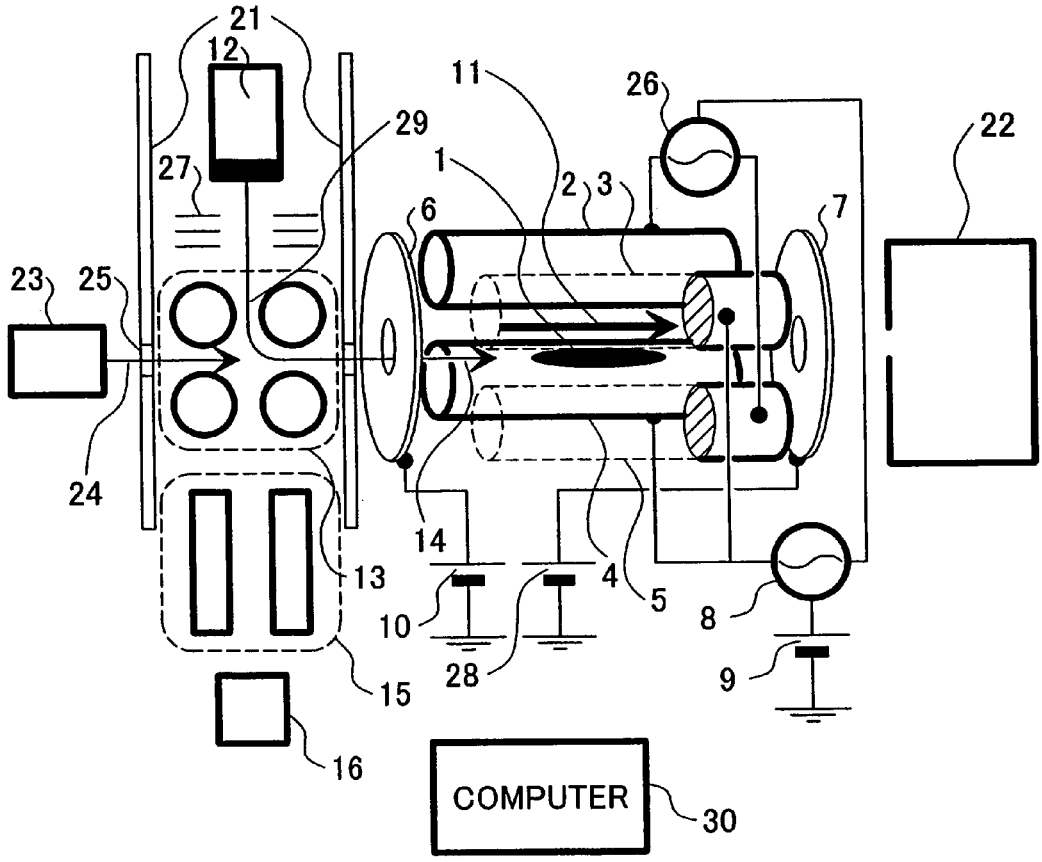
FIG. 9 is a diagram for illustrating a second example of the present invention.
Figure 10:
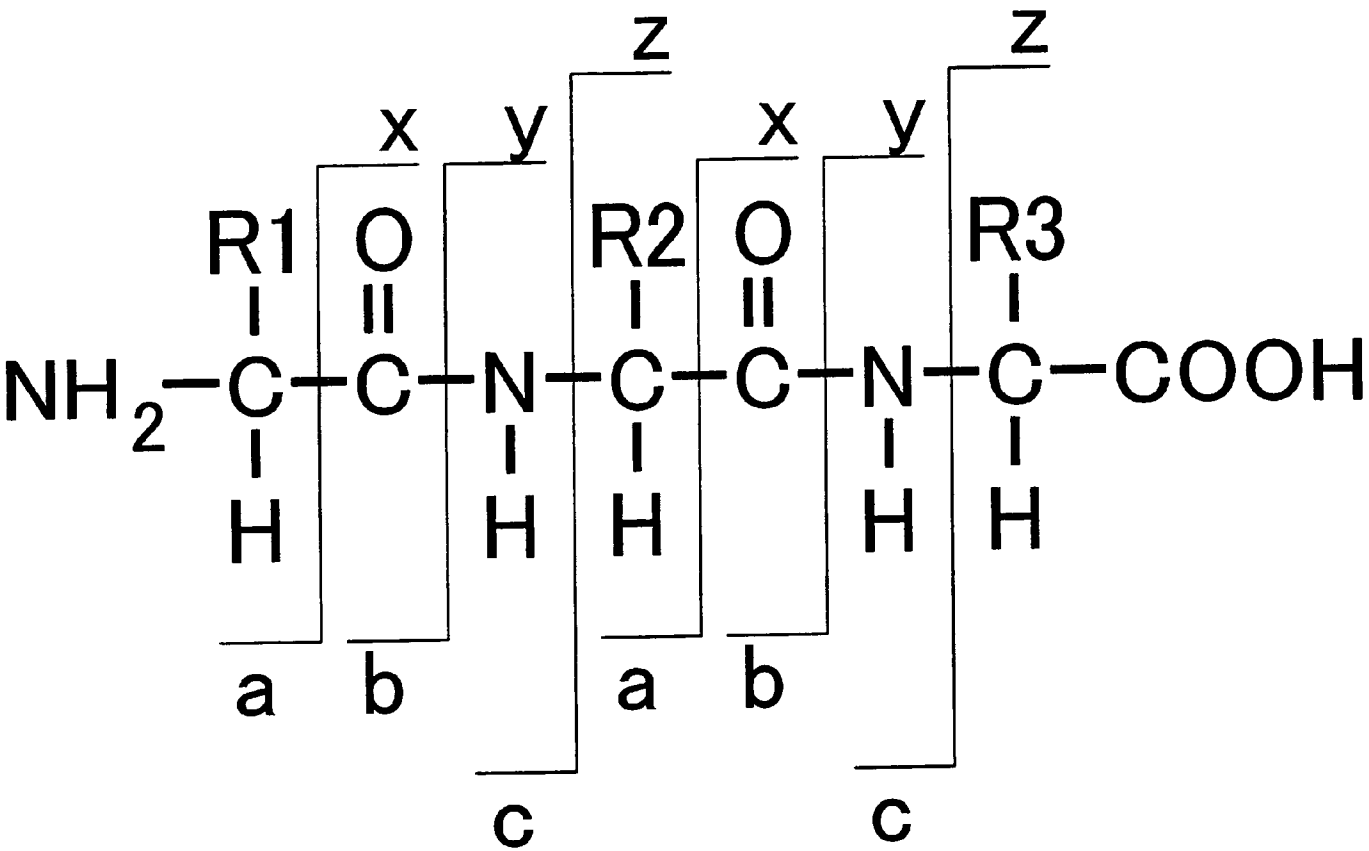
FIG. 10 is a diagram for illustrating a fragment of protein.
Figure 11:
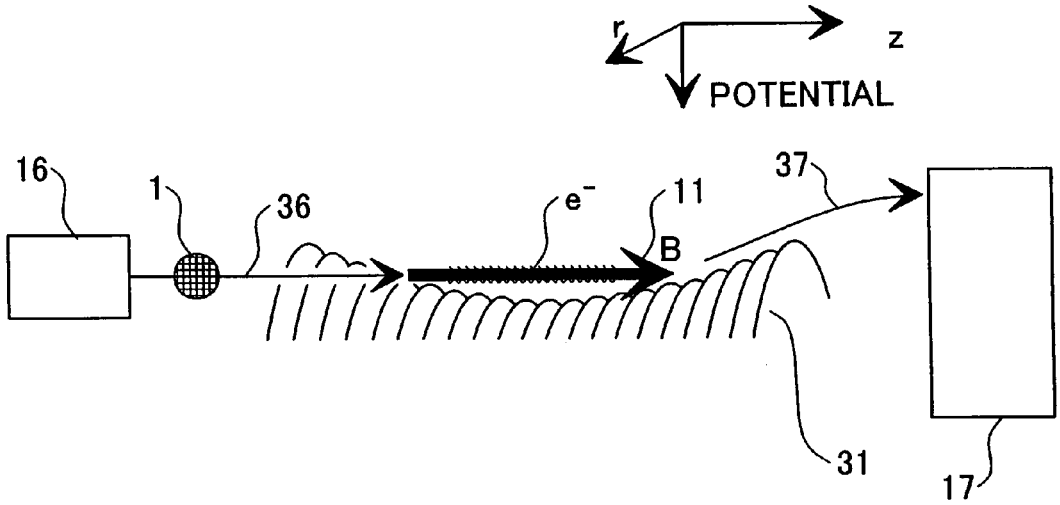
FIG. 11 is a diagram for illustrating one example of a conventional method.
Figure 12:
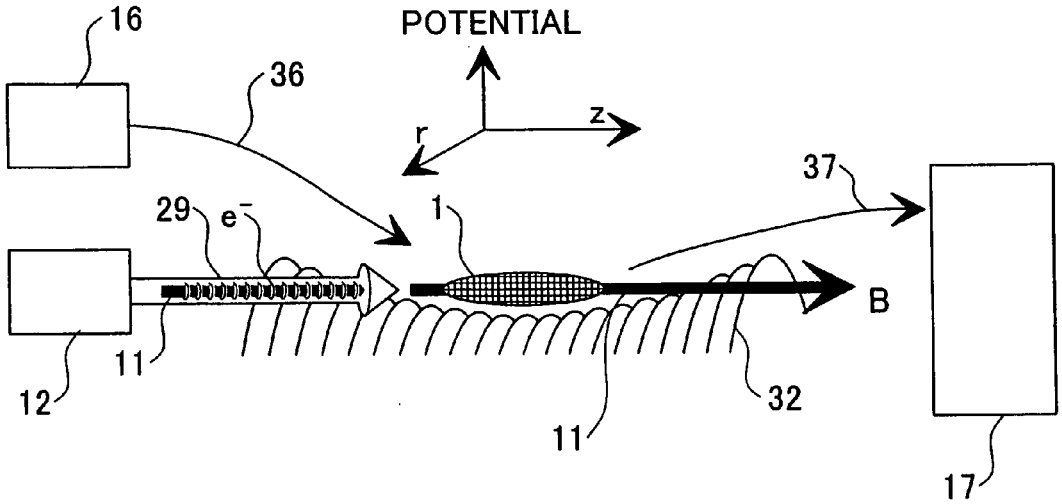
FIG. 12 is a diagram for illustrating another example of the conventional method.
Figure 13:
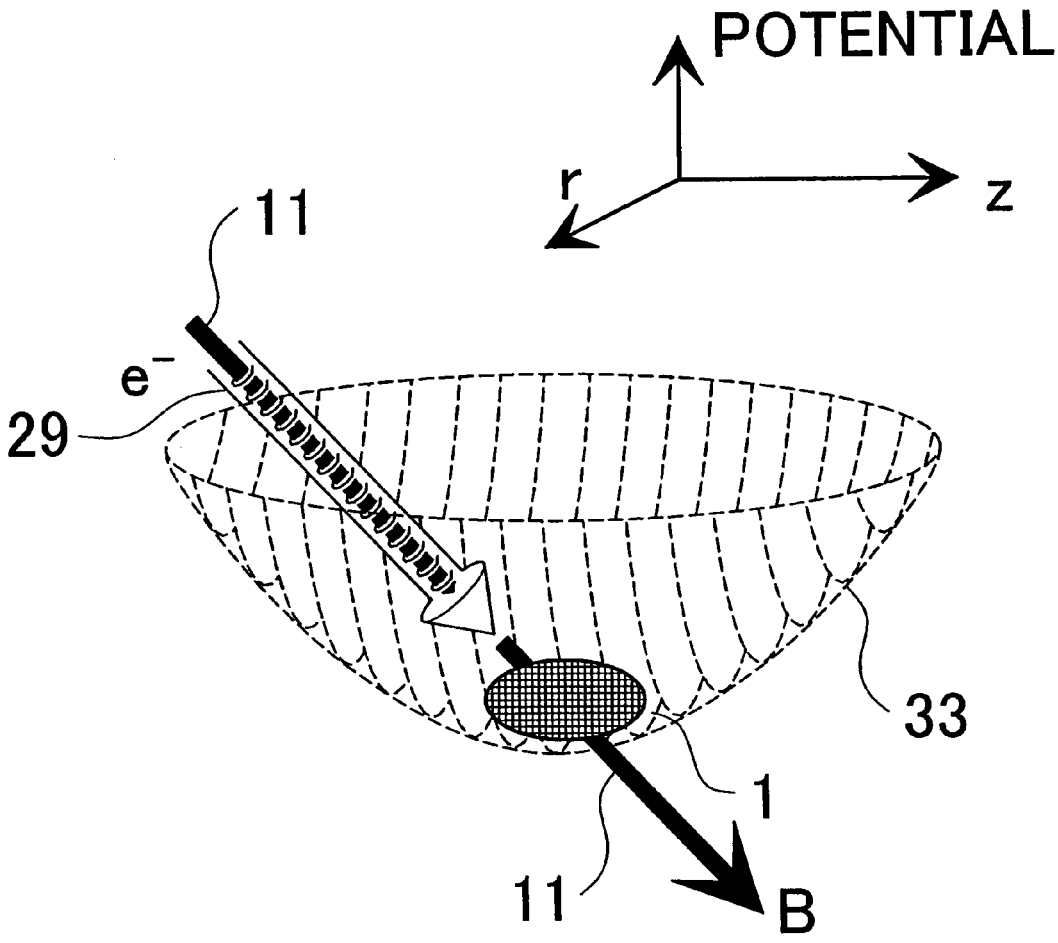
FIG. 13 is a diagram for illustrating a still other example of the conventional method.
Figure 14:
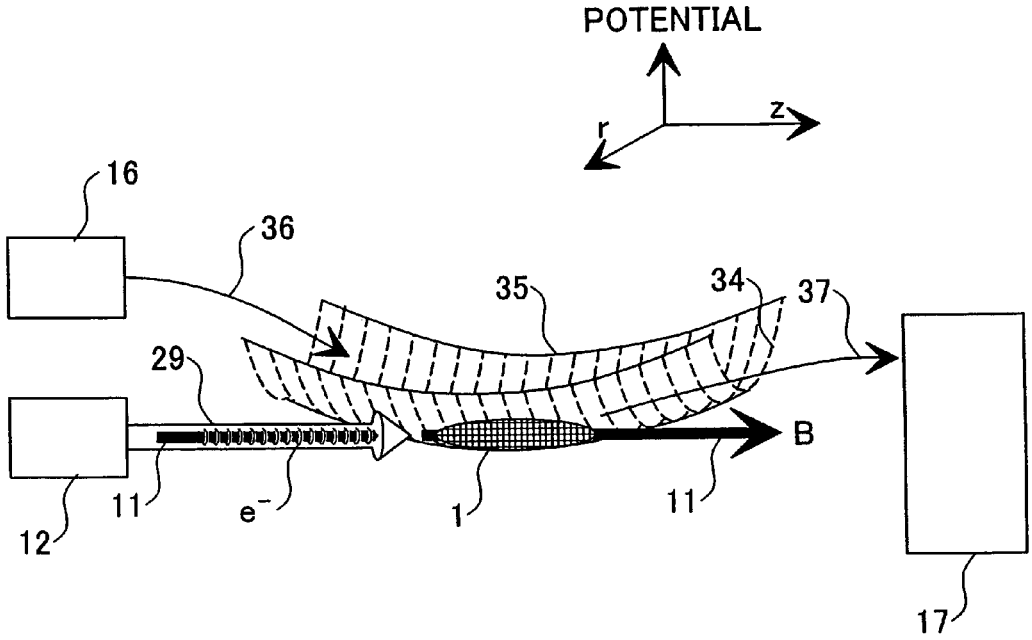
FIG. 14 is a diagram for illustrating the principle of the present invention.

FIG. 9 shows an example of a mass spectrometer optionally including a power source system for collision-induced dissociation (CID), and a laser system for infrared multiphoton dissociation (IRMPD) in order to acquire the spectrum by another molecular dissociation method which is in complementary relation to ECD.

ECD, and CID and IRMPD are the molecular dissociation methods for providing complementary sequence structure information. Therefore, it is effective for the molecular species identification to carry out both the methods in the same device. The two-dimensional combined ion trap unit 2 to 11, and 28 which is the portion related to ECD additionally has an AC power source 26 for CID. The electron source unit 12, 13, 21, and 27 additionally includes an incident hole 25 for a laser beam. The laser beam is made incident along the central axis of the two-dimensional combined ion trap, and hence the hole 25 should be made on the extension of the central axis. The laser beam produced from an IR laser 23 is indicated by an arrow 24. The ion source unit 15 and 16 is equal to that shown in Example 1. The respective units are controlled by a computer 30.

A mass analysis unit 22 can be principally selected from a variety of mass spectrometries, not limited to the TOF mass spectrometer shown in Example 1. In view of the mass analysis technique at present time, the mass analysis unit 22 is preferably a time-of-flight mass spectrometer having high speed and high mass resolving power in terms of the general versatility and price vs. effects. However, conceivably, a Fourier transform ion cyclotron resonance (FT-ICR) mass spectrometer having a higher mass resolving power than that of the time-of-flight mass spectrometer is adopted according to the application. Also conceivably, a Q mass filter is set in the mass analysis unit 22 from the viewpoint of the compatibility with triple Q mass spectrometers (each having a CID reaction cell between two Q mass filters) which have been currently used in large number as a protein analyzer. Further, when the ion trap is used, there has been established a technique for carrying out CID plural times with high efficiency. By utilizing this, it becomes possible to analyze the side chain to be attached to the fragment ion obtained in ECD. Particularly, the use of the two-dimensional ion trap enables the coupling with a high transport efficiency between the reaction cell and the ion trap.

As described above, in this example, the analysis principle as the mass analysis unit 22 is not restricted.

When a resonance AC voltage for resonating the precursor ions is applied to the two-dimensional combined ion trap, and the kinetic energy of the ions is increased, dissociation occurs due to the collision with a gas. Thus, CID can be carried out. An AC voltage source 26 is included for this purpose. The resonant frequency varies as compared with the case of the existing two-dimensional ion trap mass spectrometry in which a magnetic field is not applied due to the effects of the magnetic field. The expression of the resonant frequency in consideration of the effects of the magnetic field appears in various known documents regarding the combined ion trap.

Further, the IR laser 23 is included in order to carrying out IRMPD. At this step, in order to ensure a large overlapping between the ions 1 and the laser beam 24, the laser beam 24 is made incident coaxially with the central axis of the two-dimensional combined ion trap. To that end, the electron source 12 and the ion source 15 and 16 are disposed in a direction at 90 is degrees to the incidence axis of the two-dimensional combined ion trap, and the laser beam 24 is made incident in roughly parallel with the incidence axis of the two-dimensional combined ion trap.

Figure 16:
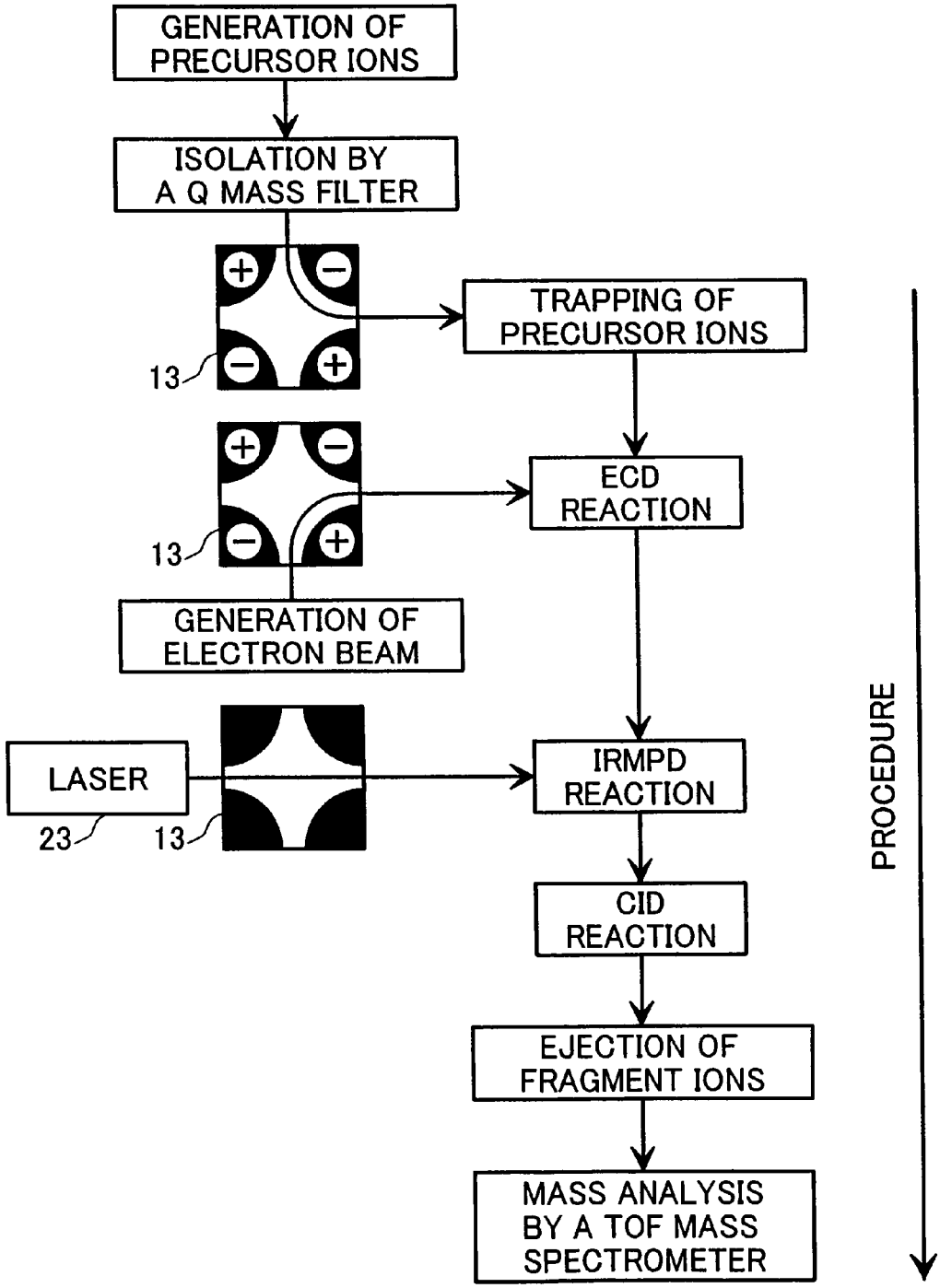
FIG. 16 is a diagram for illustrating one example of the operation procedure in the second example of the present invention.

The operation procedure of this example is shown in FIG. 16. The following procedure is conceivable. CID or IRMPD already established as a technique is mainly used. In the case where complete analysis is impossible with the techniques, ECD is used complementarily. In this case, the following is a basic operation. By the use of the two-dimensional combined ion trap, the precursor ions selected at the Q mass filter 15 are dissociated with CID and IRMPD, and subjected to mass analysis by the use of the mass analysis unit 22. The CID reaction and the IRMPD reaction are carried out inside the reaction cell. If the sequence structure information to be obtained by this operation cannot be acquired, the precursor ions are injected again into the two-dimensional combined ion trap, and irradiated with an electron beam, thereby to effect the ECD reaction. The resulting fragment ions are subjected to mass analysis by the use of the mass analysis unit 22, thereby to obtain the completed sequence information. A further specific operation procedure is carried out by reference to the procedure shown in FIG. 15 in Example 1.

Figure 22:
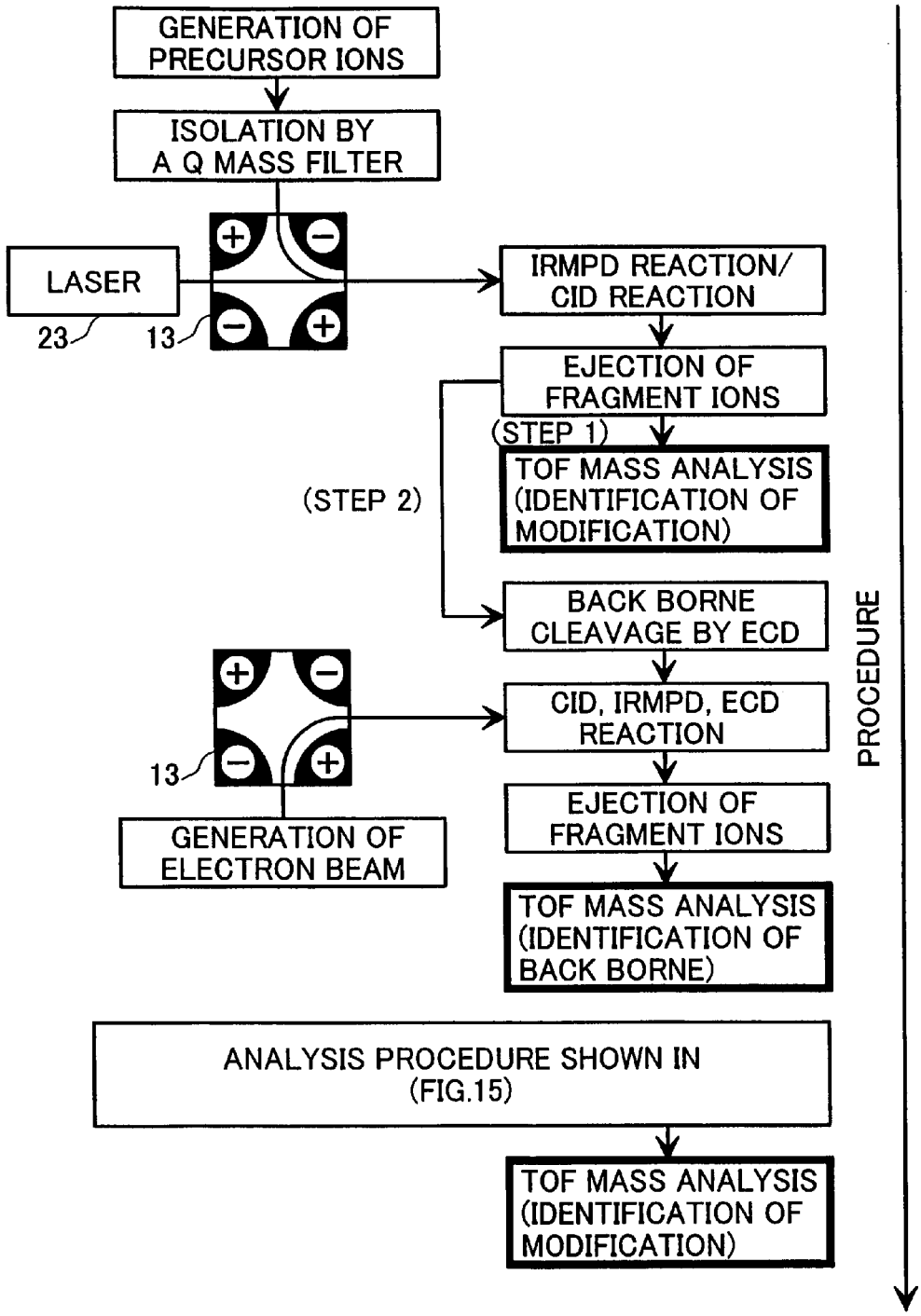
FIG. 22 is a diagram for illustrating another example of the operation procedure in the second example of the present invention.

Whereas, FIG. 22 shows one example of the operation method for carrying out the posttranslational modification as another example of the operation procedure.

First, the modified molecular species is determined. Namely, the precursor ions are injected into the two-dimensional combined ion trap, and CID and IRMPD are applied thereto. Thus, the molecular species of the modified molecule generally having a property of being likely to undergo dissociating at the bond with CID and IRMPD is determined. In the foregoing steps, the ECD reaction cell is used as a means of CID, or a means of IRMPD.

Subsequently, the sequence structure of the backbone is determined with ECD. Namely, the precursor ions are injected into the two-dimensional combined ion trap again, so that the modified sites are removed with CID and IRMPD. The sequence structure of the backbone from which the modified molecule has been removed is determined with CID, IRMPD, or ECD. When the analysis is tried with CID or IRMPD as shown in the operation method of FIG. 16, and the sequence cannot be determined, it is effective to use ECD.

Subsequently, the posttranslationally modified site is determined. The precursor ions are injected again in the two-dimensional combined ion trap, and ECD is applied thereto. The backbone is cut without removal of the modified molecule, and hence the fragment ions with the modified sites bonded thereto are generated. The modified molecule and the backbone sequence are known. Therefore, out of the fragment ions generated with ECD, the fragment ions increased in weight by the mass of the modified molecule is found to bond with the modified molecule. In other words, the modified site can be determined in this procedure. The specific method for carrying out ECD herein is the same as the procedure shown in FIG. 15 in Example 1.

As described above, by implementing ECD by using the method of the present invention, it becomes possible to provide high-throughput ECD at a low cost. In particular, by carrying out the present invention, a trapping efficiency of the precursor ions of nearly 100% is implemented. Further, it is possible to energy control the electrons still at low temperatures and inject the electrons to the precursor ions, and hence high-efficiency ECD is implemented. Eventually, the speed of the analysis of proteins in vivo or other biopolymers is increased. Further, the information of the posttranslational modification of the bonding site of a side chain can be obtained. Based on the information obtained in the foregoing manner, the contribution to the field of drug discovery is expectable.

Further, in the present invention, it is also applicable that the mass analysis unit is, other than the time-of-flight mass spectrometer, a Fourier transform mass spectrometer, a Q mass filter mass spectrometer, a magnetic sector mass spectrometer, a double-focusing mass spectrometer, an ion trap mass spectrometer, or a two-dimensional ion trap mass spectrometer.

What is claimed is:

1. A mass spectrometer comprising an ion source for generating sample ions, an ion trap composed of a multipole rod set and wall electrodes at the each end of said multipole rod set and radio frequency electric field in the r direction of said multipole rod set and a static electric field and a magnetic field, and an electron source for generating an electron beam, the mass spectrometer, further comprising a reaction cell for irradiating the ions stored in the said trap with the electron beam, and effecting an electron capture dissociation reaction, and a mass analysis part for performing mass analysis of the dissociated ions generated in the reaction cell, wherein said magnetic field is not less than 0.02 T.

2. The mass spectrometer according to claim 1, wherein a direction of application of the magnetic field is along and generally parallel to a central axis of said multipole set of said ion trap.

3. The mass spectrometer according to claim 1, wherein said wall electrodes are formed with permanent magnet with a hole opened for ion inlet and outlet.

4. The mass spectrometer according to claim 1, wherein a direction of incidence of the electron beam into the space surrounded by said multipole rod set of said ion trap is along and generally parallel to the central axis of the said ion trap.

5. The mass spectrometer according to claim 1, wherein the direction of application of the magnetic field is along and generally parallel to the central axis of the said ion trap, and the direction of incidence of the electron beam into the space surrounded by said multipole rod set of said ion trap is along and generally parallel to the central axis of the said ion trap.

6. The mass spectrometer according to claim 1, said magnetic field is generated by a permanent magnet made of neodymium-iron-boron.

7. The mass spectrometer according to claim 1, wherein said ion trap electric field includes a quadrupole radio frequency electric field.

8. The mass spectrometer according to claim 1, wherein said ion trap electric field mainly includes a hexapole radio frequency electric field or a octapole radio frequency electric field.

9. The mass spectrometer according to claim 1, wherein said quadrupole deflector for carrying out deflection of the ions is disposed on the central axis of said ion trap.

10. The mass spectrometer according to claim 1, wherein intensity of the magnetic field is 2 T or less and 0.05 T or more.

11. The mass spectrometer according to claim 1, having a permanent magnet or a normal conductive magnet, for generating the magnetic field.

12. A mass analyzing method, comprising:

generating ions of sample, isolating a precursor ion from said ions of sample, accumulating said precursor ion in a ion trap composed of a multipole rod set and wall electrodes at the each end of said multipole rod set, irradiating an electron beams to said precursor ion for ECD reaction, ejecting fragment ions by said ECD reaction from said ion trap, and analyzing said ejected ions by analyzer, wherein said ion trap is applied a radio frequency ion trap electric field and a magnetic field for said ECD reaction, and said magnetic field is not less than 0.02 T.

13. The mass analyzing method according to claim 12, further comprising the step of:

applying a resonance AC voltage to said ion trap for resonating said accumulated precursor ion before or after said ECD reaction.

14. A mass analyzing method, comprising:

generating ions of sample, isolating a precursor ion from said ions of sample, introducing said precursor ion in a ion trap composed of a multipole rod set and wall electrodes at the each end of said multipole rod set, carrying out CID or IRMPD reaction to said introduced precursor ion in said ion trap and determining modified molecular species of said precursor ion, introducing said precursor ion in said ion trap and carrying out CID or IRMPD reaction to said precursor ion to remove modified sites, carrying out CID or IRMPD or ECD reaction to said modified sites removed precursor ion and determining the sequence structure of backbone, introducing said precursor ion in said ion trap and carrying out ECD reaction to said precursor ion to cut said backbone, determining posttranslational modified site by information of determined said modified molecular species and said backbone.

15. A mass spectrometer comprising:

an ion source for generating sample ions, an ion trap composed of a multipole rod set and wall electrodes at the each end of said multipole rod set and radio frequency electric field in the r direction of said multipole rod set and a static electric field and a magnetic field, and an electron source for generating an electron beam, the mass spectrometer, further comprising a reaction cell for irradiating the ions stored in the said trap with the electron beam, and effecting an electron capture dissociation reaction, and a mass analysis part for performing mass analysis of the dissociated ions generated in the reaction cell, and a quadrupole deflector for carrying out deflection of the ions is disposed on the central axis of the said ion trap, wherein said magnetic field is not less than 0.02 T.

16. A mass spectrometer comprising:

an ion source for generating sample ions, an ion trap composed of a multipole rod set and wall electrodes at the each end of said multipole rod set and radio frequency electric field in the r direction of said multipole rod set and a static electric field and a magnetic field, a vacuum vessel for setting said ion trap in vacuum pressure, an electron source for generating an electron beam, a reaction cell for irradiating the ions stored in the said trap with the electron beam, and effecting an electron capture dissociation reaction, and a mass analysis part for performing mass analysis of the dissociated ions generated in the reaction cell, wherein said vacuum pressure is no less than $10^{-3}$ Pa and no more than $10^{-1}$ Pa.

* * * * *